US011738828B2

(12) United States Patent
Duggal et al.

(10) Patent No.: US 11,738,828 B2
(45) **Date of Patent: *Aug. 29, 2023**

(54) DISCONNECTABLE YOKE MOORING SYSTEMS AND PROCESSES FOR USING SAME

(71) Applicant: SOFEC, INC., Houston, TX (US)

(72) Inventors: Arun Sanjay Duggal, Houston, TX (US); Stephen P. Lindblade, Waller, TX (US); Miles A. Hobdy, Richmond, TX (US); Hao Yu, Katy, TX (US)

(73) Assignee: SOFEC, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/155,527

(22) Filed: Jan. 17, 2023

(65) Prior Publication Data

US 2023/0150614 A1 May 18, 2023

Related U.S. Application Data

(63) Continuation of application No. 17/962,087, filed on Oct. 7, 2022.

(Continued)

(51) Int. Cl.
*B63B 21/16* (2006.01)
*B63B 21/04* (2006.01)

(Continued)

(52) U.S. Cl.
CPC ..... *B63B 21/16* (2013.01); *B63B 21/04* (2013.01); *B63B 21/26* (2013.01); *B63B 2021/002* (2013.01); *B63B 2021/003* (2013.01)

(58) Field of Classification Search
CPC ..... B63B 21/00; B63B 2021/00; B63B 2021/003; B63B 21/04; B63B 21/26

(Continued)

(56) References Cited

U.S. PATENT DOCUMENTS 3,541,622 A * 11/1970 Harlow ..... B63B 22/021 114/230.1
4,516,942 A 5/1985 Pedersen (Continued)

FOREIGN PATENT DOCUMENTS

AU 2003201516 B2 12/2009
AU 2021200735 B2 12/2021

(Continued)

OTHER PUBLICATIONS

International Search Report and Written Opinion of the International Searching Authority dated Feb. 3, 2023, for PCT/US2022/046072.

*Primary Examiner* — Daniel V Venne
(74) *Attorney, Agent, or Firm* — Edmonds & Cmaidalka, P.C.

(57) ABSTRACT

Yoke mooring systems and processes for using same. The system can include a turntable connected to and rotatable with respect to a base. A yoke can be connected to the turntable such that the yoke can at least partially rotate about a longitudinal axis of the yoke and at least partially rotate about a second axis that can be orthogonal to the longitudinal axis. A first and second link arm can be connected to the yoke and to a first component of a first and a second releasable connector, respectively. A first and second lifting line can be connected to the second end of the first and second link arms, respectively. A first and second lifting device can be disposed on a vessel and configured to be connected to a second end of the first and second lifting lines, respectively, to lift and lower the link arms and the yoke.

30 Claims, 20 Drawing Sheets

Related U.S. Application Data

(60) Provisional application No. 63/253,710, filed on Oct. 8, 2021.

(51) Int. Cl.
*B63B 21/26* (2006.01)
*B63B 21/00* (2006.01)

(58) Field of Classification Search
USPC ..... 114/230.1, 230.15, 230.2, 230.26
See application file for complete search history.

(56) References Cited

U.S. PATENT DOCUMENTS

| | | | | |
|---|---|---|---|---|
| 4,530,302 | A | 7/1985 | Pedersen | |
| 4,533,332 | A | 8/1985 | Coppens et al. | |
| 4,665,856 | A | 5/1987 | Pedersen | |
| 4,917,038 | A | 4/1990 | Poldervaart et al. | |
| 6,851,994 | B2 | 2/2005 | Boatman et al. | |
| 7,007,623 | B2 | 3/2006 | Boatman et al. | |
| 7,322,308 | B2 | 1/2008 | De Baan | |
| 7,543,543 | B2 * | 6/2009 | Boatman | B63B 21/50 114/230.14 |
| 8,181,662 | B2 | 5/2012 | Pollack et al. | |
| 9,573,659 | B2 | 2/2017 | Liu et al. | |
| 11,267,532 | B2 | 3/2022 | Yu et al. | |
| 11,279,446 | B2 | 3/2022 | Yu et al. | |
| 11,305,843 | B2 | 4/2022 | Hovde et al. | |
| 2011/0139054 | A1 | 6/2011 | Liu et al. | |
| 2021/0354789 | A1 | 11/2021 | Lie Eide et al. | |
| 2022/0371691 | A1 | 11/2022 | Cottrell | |

FOREIGN PATENT DOCUMENTS

| | | | |
|---|---|---|---|
| WO | 2003059728 | A1 | 7/2003 |
| WO | 2020127792 | A1 | 6/2020 |
| WO | 2021092385 | A1 | 5/2021 |

* cited by examiner

DISCONNECTABLE YOKE MOORING SYSTEMS AND PROCESSES FOR USING SAME

CROSS-REFERENCE TO RELATED APPLICATIONS

This application is a continuation of co-pending U.S. patent application Ser. No. 17/962,087, filed on Oct. 7, 2022, which claims priority to U.S. Provisional Patent Application No. 63/253,710, filed on Oct. 8, 2021, which are both incorporated by reference herein.

FIELD

Embodiments described generally relate to yoke mooring systems for vessels such as oil tankers, floating production storage and offloading (FPSO) facilities, floating liquified natural gas (FLNG) facilities, floating renewable energy facilities, e.g., hydrogen/ammonia, and/or floating nuclear power facilities. More particularly, such embodiments relate to disconnectable yoke mooring systems that can be used to moor floating vessels that can be disconnected in the event of oncoming severe weather and reconnected thereafter and processes for using same.

BACKGROUND

In the offshore oil and gas industry, yoke mooring systems have been used for many years to permanently moor a vessel on a surface of a body of water. This is typically performed in relatively shallow waters, for example less than 50 meters of water. The yoke mooring system can have a yoke that is above the surface of the water or below the surface of the water. Up until recently it has not been possible to quickly disconnect from a yoke mooring system and, in particular from a submerged yoke mooring system.

Recent developments have made disconnectable yoke mooring systems feasible, but only when the yoke is disposed above the surface of a body of water. These above water disconnectable yoke mooring systems can be costly given that there is significant expense required to locate the yoke above the surface of the body of the water.

There is a need, therefore, for new disconnectable yoke mooring systems and processes for using same.

SUMMARY

Disconnectable yoke mooring systems for mooring a vessel floating on a surface of a body of water and processes for using same are provided. In some embodiments, the disconnectable yoke mooring system can include a base structure, a turntable, a yoke, a first link arm, a second link arm, a first releasable connector, a second releasable connector, a first lifting device, and a second lifting device. The base structure can be configured to be disposed on a seabed. The turntable can be configured to be connected to the base structure such that the turntable can be rotatable with respect to the base structure about a vertical axis. The yoke can have a first end and a second end. The first end of the yoke can be configured to be connected to the turntable in a manner that can permit the yoke to at least partially rotate about a longitudinal axis of the yoke and to at least partially rotate about a second axis that can be substantially orthogonal to the longitudinal axis of the yoke. The first link arm and the second link arm can each have a first end connected to the second end of the yoke. The first releasable connector and the second releasable connector can each include a first component disposed on a second end of the first link arm and a second end of the second link arm, respectively. The first releasable connector and the second releasable connector can each include a second component that can be configured to be disposed on the vessel. The first lifting line and the second lifting line can each have a first end configured to be connected to the second end of the first link arm and the second link arm, respectively. The first lifting device and the second lifting device can each be configured to be disposed on the vessel. The first lifting device and the second lifting device can be configured to be connected to a second end of the first lifting line and a second end of the second lifting line, respectively. When the first and second lifting devices are disposed on the vessel and connected to the second end of the first and second lifting lines, respectively, and the first end of the first and second lifting lines are connected to the second end of the first and second link arms, respectively, the first and second lifting devices can be configured to lift and lower the first and second link arms and the yoke.

BRIEF DESCRIPTION OF THE DRAWINGS

The various aspects and advantages of the preferred embodiment of the present invention will become apparent to those skilled in the art upon an understanding of the following detailed description of the invention, read in light of the accompanying drawings which are made a part of this specification.

DETAILED DESCRIPTION

Figure 1:
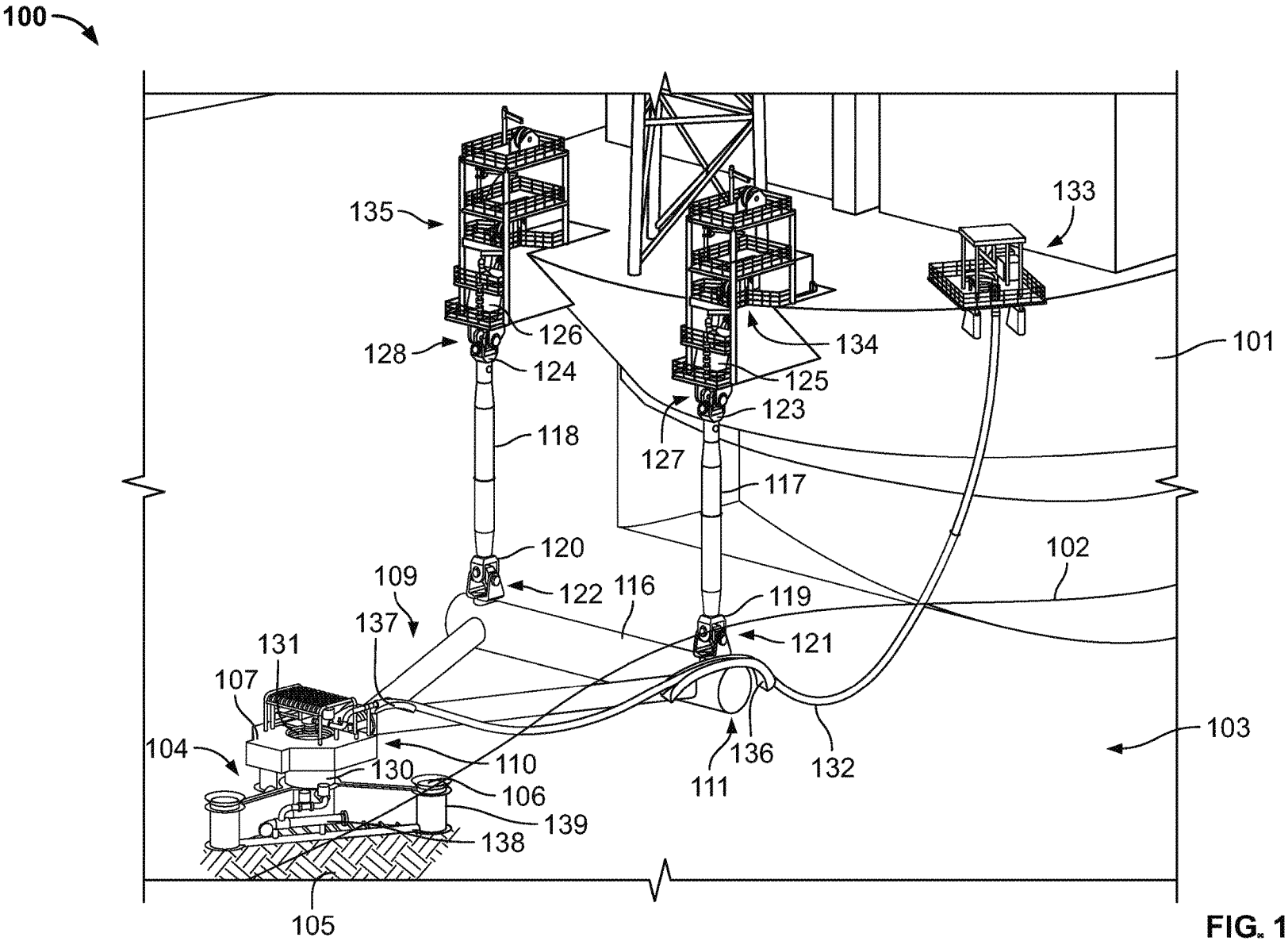
FIG. 1 depicts an isometric view of an illustrative disconnectable yoke mooring system, according to one or more embodiments described.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to." Also, as used herein the indefinite articles 'a' and 'an' should be interpreted to mean "at least one" or "one or more."

All numerical values in this disclosure are exact or approximate values ("about") unless otherwise specifically stated. Accordingly, various embodiments of the disclosure may deviate from the numbers, values, and ranges disclosed herein without departing from the intended scope.

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and processes of using the same may be equally effective at various angles or orientations.

Figure 2:
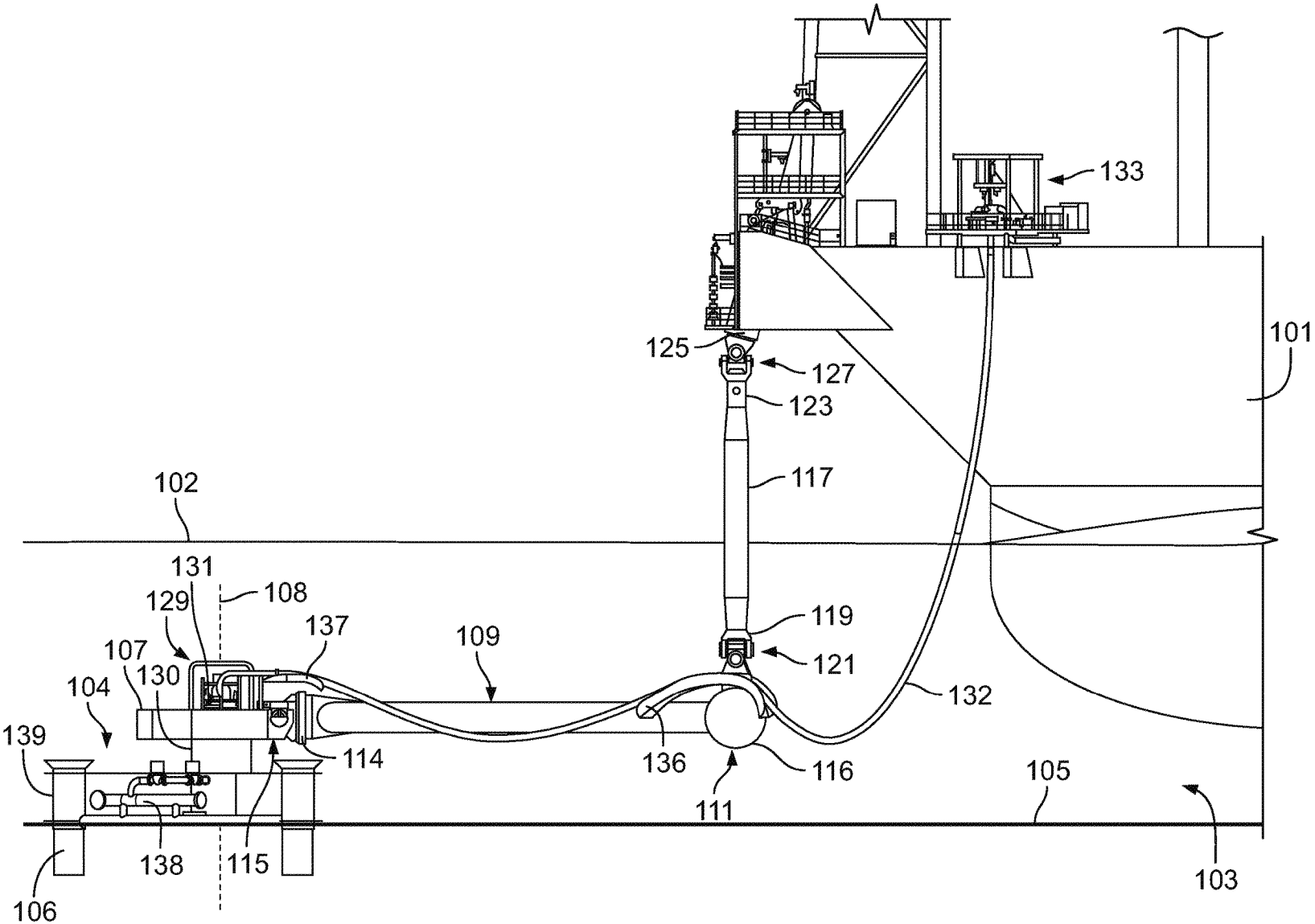
FIG. 2 depicts a side elevation view of the disconnectable yoke mooring system shown in FIG. 1.
Figure 3:
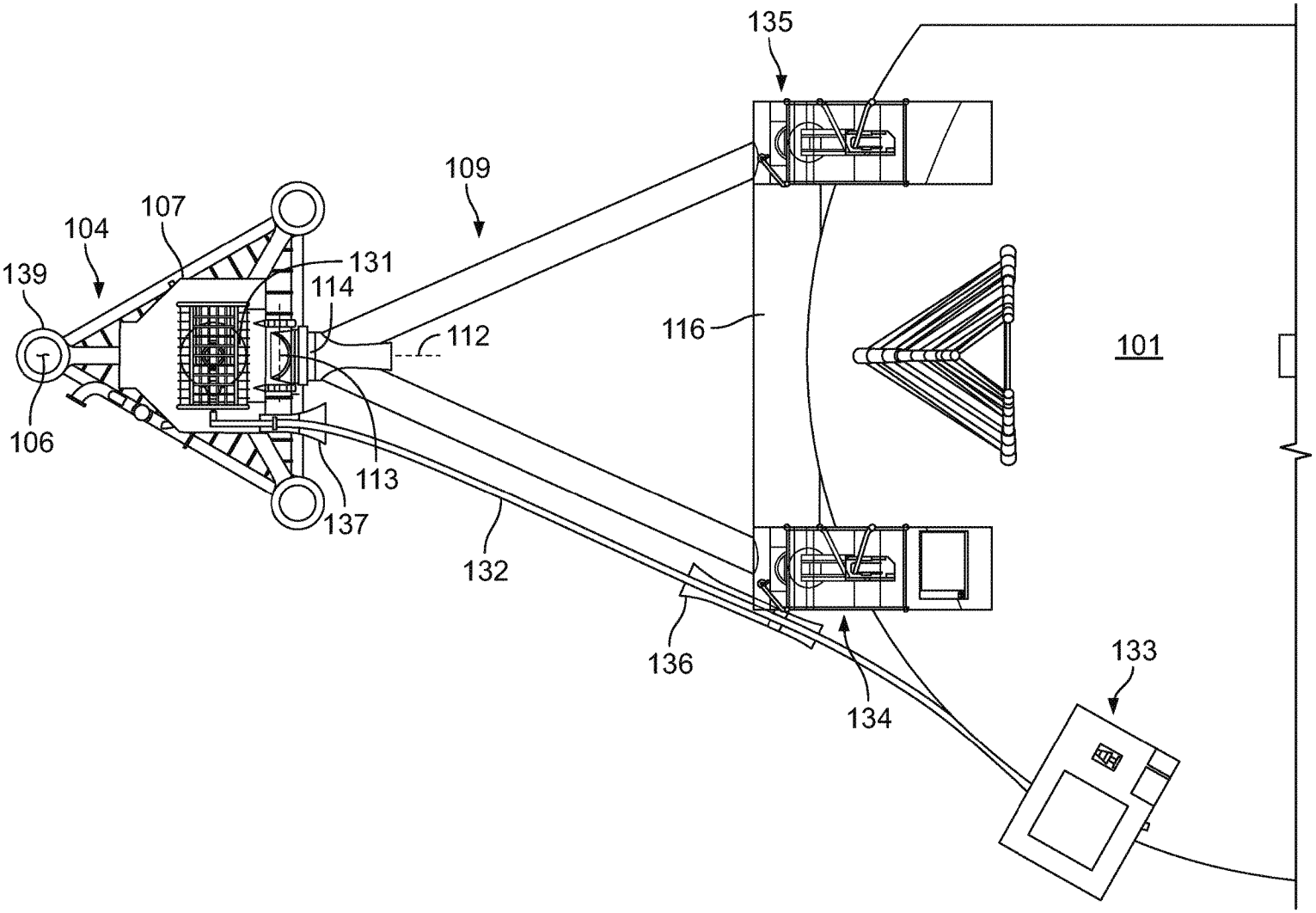
FIG. 3 depicts a plan view of the disconnectable yoke mooring system shown in FIG. 1.

FIGS. 1-3 depict an isometric view, a side elevation view, and a plan view, respectively, of an illustrative disconnectable yoke mooring system 100 for mooring a vessel 101 floating on a surface 102 of a body of water 103, according to one or more embodiments. Referring to FIGS. 1-3, in some embodiments the yoke mooring system 100 can include a base structure 104 configured to be secured to or disposed on a seabed 105 below the surface 102 of the body of water 103. In some embodiments, the base structure 104 can be fixed or secured to the seabed 105 with driven piles or suction piles 106, as shown. More particularly, as shown, the base structure 104 can include one or more pile sleeves 139 that can be disposed about the one or more piles 106 to fix or secure the base structure 104 to the seabed 105. In other embodiments, the base structure 104 can be a gravity-based structure (not shown). The particular manner in which the base structure 104 can be disposed on the seabed 105 can be based, at least in part, on the seabed conditions at the site and/or expected loading forces transmitted thereto when the vessel 101 is moored to the base structure 104 via the yoke mooring system 100. It should be understood that when the base structure 104 is a gravity-based structure, in some embodiments, the base structure 104 can maintain an acceptable orientation with respect to the seabed 105 without requiring the base structure 104 to include driven piles, suction piles, or the like that can be physically connected to the seabed 105.

The yoke mooring system 100 can also include a turntable 107 that can be configured to be rotatively connected to the base structure 104. The turntable 107 can be configured to rotate about a vertical or a substantially vertical axis 108 with respect to the base structure 104.

The yoke mooring system 100 can also include a yoke structure or simply "yoke" 109 that can have a first end 110 and a second end 111. The yoke 109 can be a fabricated, e.g., steel, structure. In some embodiments, the first end 110 of the yoke 109 can be configured to connect to the turntable 107 in a manner that can permit the yoke 109 to at least partially rotate about a longitudinal axis or roll axis 112 of the yoke 109. In some embodiments, the yoke can also be configured to connect to the turntable 107 in a manner that can permit the yoke 109 to at least partially rotate or pivot about a second axis or pitch axis 113 that can be orthogonal or substantially orthogonal or perpendicular to the longitudinal axis 112 of the yoke 109. In some embodiments, the second axis 113 can be within +/−10 degrees, +/−5 degrees, +/−3 degrees, or +/−1 degree of being orthogonal or perpendicular to the longitudinal axis 112 of the yoke 109.

In some embodiments, the connection between the first end 110 of the yoke 109 and the turntable 107 can include a roll bearing, a bushing, or the like 114. In some embodiments, the roll bearing, bushing, or the like 114 can be disposed on the first end 110 of the yoke 109 (as shown) or on the turntable 107 or between the first end 110 and the second end 111 of the yoke 109 in other embodiments. In some embodiments, the longitudinal axis 112 of the yoke 109 can be horizontal or substantially horizontal, e.g., within +/−10 degrees, +/−5 degrees, +/−3 degrees, or +/−1 degree, with respect to a horizontal plane when the vessel 101 is connected to the turntable 107 via the yoke mooring system 100 and is in a neutral or static position with respect to the base structure 104. In some embodiments, the rotative or pivotable connection between the first end 110 of the yoke 109 and the turntable 107 can include at least one pitch bearing or trunnion arrangement 115.

In some embodiments, the yoke 109 can include a ballast tank, a weight, or a combination thereof 116 that can be connected toward or at the second end 111 of the yoke 109. For simplicity and ease of description a ballast tank will be further used to describe the system, but the use of the term "ballast tank" can be replaced with the term "weight" or a combination of the terms "ballast tank and a weight". Additionally, the yoke mooring systems 100, 200, 900, and 1000 will be further described as including the ballast tank 116. However, it should be understood that the ballast tank 116 can be an optional component and, as such, not included in some embodiments. The ballast tank 116 can be configured to contain a ballast material. The ballast tank 116 can also be a fabricated, e.g., steel, structure. In some embodiments, the yoke 109 that includes the ballast tank 116 can be disposed below the surface 102 of the body of water 103. The ballast material can have a specific gravity that is greater than that of the water 103. Examples of ballast material can be or can include, but are not limited to, concrete, sand, aggregate, iron ore, magnetite, rocks, drilling mud, any other material that has a specific gravity greater than that of the water, or any combination or mixture thereof. The weight, if present, can be a body having a fixed mass, e.g., a solid metal body.

The yoke mooring system 100 can also include at least one link arm (two are shown, 117, 118) that can be configured to connect the second end 111 of the yoke 109, e.g., via the ballast tank 116, to the vessel 101. In some embodiments, a single link arm can include two arms each having a first end connected to the ballast tank 116 or the second end 111 of the yoke 109 where the first end of each arm converges at the second end thereof such that the single link arm can include a single connector configured to connect to the vessel 101. In other embodiments, the yoke mooring system 100 can include three, four, or more link arms that can be configured to connect the ballast tank 116 or the second end 111 of the yoke 109 to the vessel 101.

In some embodiments, the link arms 117, 118 can be or can include one or more elongated rigid structures, one or more chains, one or more cables, or any other suitable elongated member, or any combination thereof. In some embodiments, a first end 119, 120 of each link arm 117, 118 can be configured to connect to the ballast tank 116 or the second end 111 of the yoke 109 via a coupler 121, 122, respectively. Similarly, in some embodiments, a second end 123, 124 of each link arm 117, 118 can be configured to connect to the vessel 101 or, as shown, a releasable connector (two are shown, 125, 126) via a coupler 127, 128, respectively. In other embodiments, the couplers 121, 122, 127, 128 can be or can include, but are not limited to, universal joints, ball and socket joints, flexible joints that can include a plurality of steel and rubber spherical layers laminated together to provide rotational articulation about two non-parallel axes disposed at each end thereof, a pad-eye, a tri-plate, or any other suitable coupler. In some embodiments, the link arms 117, 118 can be connected to the ballast tank 116 or the second end 111 of the yoke 109 and/or to the vessel 101 or the releasable connectors 125, 126 via the same type of coupler or via different types of couplers. An illustrative commercially available flex joint can include the FLEXJOINT® available from Oil States Industries. In some embodiments, the link arms 117, 118 can include an axial bearing disposed at one end of each link arm 117, 118 that can be configured to permit rotation about the axis of the link arm 117, 118 at one end of the link arm 117, 118 relative to the other end of the link arm 117, 118. In other embodiments, the yoke 109 and/or the ballast tank 116 can be connected to the vessel 101 or the releasable connectors 125, 126 via a synthetic material such as an ultra-high molecular weight polyethylene. Illustrative synthetic materials suitable for use in fabricating the link arms can be or can include, but is not limited to, DYNEEMA® available from DSM.

In some embodiments, the yoke mooring system 100, when mooring the vessel 101 to the base structure 104 can be at least partially submerged. For example, the base structure 104, the turntable 107, the yoke 109, the ballast tank 116, and a portion of the link arms 117, 118 can be located below the surface 102 of the water 103 and a portion of the link arms 117, 118 can be located above the surface 102 of the water 103 when the vessel 101 is moored to the base structure 104 of the yoke mooring system 100. When the yoke mooring system 100 is disconnected from the yoke mooring system 100, the link arms 117, 118 can also be located below the surface 102 of the water 103 (see FIGS. 15-18). In another example, the base structure 104, the turntable 107, the yoke 109, the ballast tank 116, the link arms 117, 118, and a first component of the releasable connectors 125, 126 can be located below the surface 102 of the water 103 when the vessel 101 is moored to the base structure of the yoke mooring system 100.

In some embodiments, one or more of the link arms 117, 118 can include one or more in-line shock absorbers configured to reduce dynamic loading during connection and disconnection of the link arm 117, 118 to and from the vessel 101. In some embodiments, the shock absorber can be a gas spring with hydraulic damping. In other embodiments, the shock absorber can be a rubber or elastomeric shock absorber. One suitable shock absorber is further described below with reference to FIGS. 13 and 14.

As noted above, in some embodiments, the yoke mooring system 100 can also include the releasable connectors 127, 128). In some embodiments, the yoke mooring system 100 can include one, two, three, four, or more releasable connectors, with the number of releasable connectors corresponding to the number of link arms. The releasable connectors 127, 128 can each include a first component disposed on the second ends 123, 124 of each link arm 117, 118 and a second component disposed on the vessel 101. As shown, the first component of each releasable connectors 127, 128 can be connected to the second ends 123, 124 of the link arms 117, 118 via the couplers 127, 128, respectively. In some embodiments, the releasable connectors 127, 128 can include a stinger connected to the link arms and can include a sleeve assembly connected to or mounted on the vessel (see FIGS. 11 and 12). In some embodiments, the releasable connectors 127, 128 can include a latching mechanism that can be moved from an unlocked position to a locked position to secure the stinger within the sleeve (see FIGS. 11 and 12). In other embodiments, the releasable connectors 127, 128 can include a mooring cradle configured to receive and secure the second ends 123, 124 of the link arms 117, 118, respectively, to the vessel 101. For example, the couplers 127, 128 can be configured to be placed into grooves of the mooring cradle and a pin or other body can be placed through the coupler such that the pin or other body can be supported by the mooring cradle. In such embodiment, a securing device, e.g., a top plate, can optionally be secured to the top of the mooring cradle to prevent the coupler from disconnecting from the mooring cradle.

In some embodiments, the yoke mooring system 100 can also include one or more fluid swivels 129 that can include a rotating part disposed on the turntable 107 and fixed part disposed on the base structure 104. The fluid swivel 129 can include a fixed part (disposed on the base structure 104, e.g., within a housing 130 of the base structure 104, that can be coupled to a rotating part 131 disposed on the turntable 106. The fluid swivel 129 can be configured to provide unlimited rotative fluid connectivity between one or more fluid paths therethrough. In such embodiment, one or more fluid conduits (one is shown, 132) configured to transfer one or more fluids from the fluid swivel 129 to the vessel 101 and/or from the vessel 101 to the fluid swivel 129 can be connected between the vessel 101 and the rotating part 131 of the fluid swivel 129. The fixed part of the fluid swivel 129 can be in fluid communication with a subsea pipeline or pipeline end manifold 138.

In some embodiments, the fluid swivel 129 can include a single fluid flow path or can include two, three, four, or more fluid flow paths therethrough. When the fluid swivel 129 includes two or more fluid flow paths therethrough, the two or more fluid flow paths can be configured to remain segregated from one another. In some embodiments, when the fluid swivel 129 includes two or more flow paths therethrough, the two or more flow paths can be configured to transfer a fluid from the rotating part 131 of the fluid swivel 129 to the vessel 101 or from the vessel 101 to the rotating part 131 of the fluid swivel 129. In other embodiments, when the fluid swivel 129 includes two or more flow paths therethrough, at least one fluid flow path can be configured to transfer a fluid from the rotating part 131 of the fluid swivel 129 to the vessel 101 and at least one fluid flow path can be configured to transfer a fluid from the vessel 101 to the rotating part 131 of the fluid swivel 129.

In some embodiments, the vessel 101 can include a riser porch system 133 disposed on the vessel 101. The riser porch system 133 can be configured to fluidly connect the fluid conduit 132 to one or more storage tanks or other storage structures disposed on and/or within the vessel 101. The fluid conduit 132 can be a flexible pipe, a series of rigid pipes connected together with a plurality of swivel joints, a flexible hose, or any combination thereof. In some embodiments, the fluid conduit 132 can be configured in a wave or catenary configuration and can be supported at one or more locations that can be selected from the turntable 107, the yoke 109, the ballast tank 116, the link arms 117, 118, and/or the vessel 101. As shown, the fluid conduit 132 can be supported by one or more ballast tank bending shoes 136 and/or one or more turntable bending shoes 137.

In some embodiments, the fluid conduit 132 can include a quick disconnect/quick connect fitting on an end of the fluid conduit connected to the vessel 101 to permit relatively fast connection and disconnection or reconnection of the fluid conduit 132 to and from the vessel 101. In other embodiments, the fluid conduit 132 can have a quick disconnect/quick connect fitting on an end connected to the rotating part 131 of the fluid swivel 129. In such embodiment, the fluid conduit 132 connected to the rotating part 131 of the fluid swivel 132 can be retrieved from the body of water 103 and taken with the vessel 101 upon disconnection of the vessel 101 from the yoke mooring system 100. In still other embodiments, the fluid conduit 132 can include a quick disconnect/quick connect fitting disposed between the first and second ends thereof such that a portion of the fluid conduit 132 can remain at in the body of water and a portion of the fluid conduit 132 can be retrieved onto the vessel 101 and taken with the vessel 101 upon disconnection of the vessel 101 from the yoke mooring system 100, as further described with reference to FIG. 4.

Figure 4:
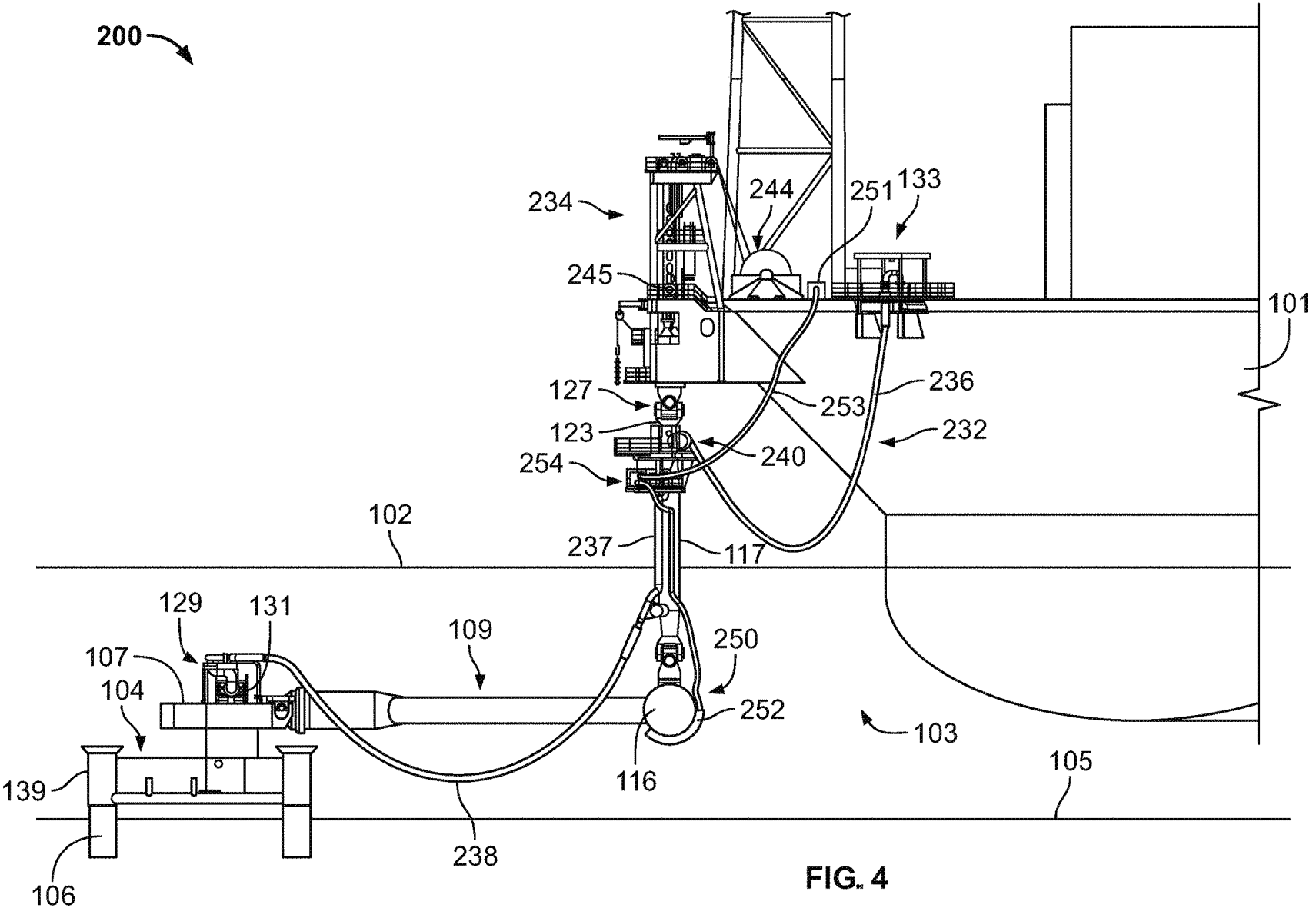
FIG. 4 depicts a side elevation view of another illustrative disconnectable yoke mooring system, according to one or more embodiments described.

FIG. 4 depicts a side elevation view of another illustrative disconnectable yoke mooring system 200, according to one or more embodiments. The yoke mooring system 200 is similar to the yoke mooring system 100 with a few differences. The first difference is that the yoke mooring system 200 can include a multi-segment fluid conduit 232. As shown, the fluid conduit 232 can include a first segment 236 coupled between the riser porch system 133 and a junction or connection point 240 located toward the second end 123 of the first link arm 117. The fluid conduit 232 can also include second segment 237 that can extend down a portion of the first link arm 117. The second segment 237 can be fluidly coupled to a third segment 238 that can be in fluid communication with the rotating part 131 of the fluid swivel 129. In the embodiment shown in FIG. 4, the first segment 236 and the third segment 238 can be flexible and the second segment 237 can be rigid.

A second difference between the yoke mooring system 100 is that the yoke mooring system 200 is depicted as including a jetting system 250. The jetting system 250 can include a pressurized fluid source 251, a jetting pad 252, and a fluid conduit 253 that can be configured to convey a pressurized fluid from the pressurized fluid source 251 to the jetting pad 252 such that the pressurized fluid can be ejected toward the seabed 105 when the yoke 109 and the ballast tank 116 are about to or is/are being raised off the seabed 105 during connection of the vessel 101 to the yoke mooring system 200. Suitable pressurized fluids can be or can include, but are not limited to, a gas, a liquid, or a mixture thereof. In some embodiments, the suitable gases can be or can include, but are not limited to, air, nitrogen, carbon dioxide, or other available gas. In some embodiments, a suitable liquid can be or can include, but is not limited to, water, e.g., sea water or fresh/potable water.

The jetting system 250 can help facilitate separation of the yoke 109 and the ballast tank 116 from the seabed 105. Depending, at least in part, on the type of seabed 105, the seabed 105 can be rather soft such that yoke 109 and the ballast tank 116 can sink into the seabed 105 thereby making it more difficult to raise the yoke 109 and the ballast tank 116 off the seabed during connection of the vessel 101 to the yoke mooring system 200.

As shown in FIG. 4, the conduit 253, similar to the conduit 232 can include a first segment coupled between the pressurized fluid source 251 and a junction or connection point 254 located toward the second end 123 of the first link arm 117. The fluid conduit 232 can also include a second segment that can extend down a portion of the first link arm 117. The second segment can be fluidly coupled to a third segment that can be in fluid communication with the jetting pad 252. In the embodiment shown in FIG. 4, the first segment and the third segment of conduit 253 can be flexible and the second segment can be rigid.

A third difference between the yoke mooring system 100 is that the yoke mooring system 200 is depicted as including a lifting device 234 that includes a rotary winch 244 that includes a first and a second independent drum and a traveling block 245 that can be used to lift and lower the link arms 117, 118 and the yoke 109 and the ballast tank 116 during connection and disconnection of the vessel 101 to the yoke mooring system 200. Illustrative lifting devices will be further described below.

Returning to FIGS. 1-3, the yoke mooring system 100 can also include at least one lifting line, as further described below with reference to FIGS. 5-8. In some embodiments, the yoke mooring system 100 can include one, two, three, four, or more lifting lines. Each lifting line can be configured to engage or otherwise cooperate with a lifting arrangement, as further described below with reference to FIGS. 5-8. The lifting lines can be or can include, but are not limited to, chains, wire ropes, synthetic ropes, natural ropes, or other suitable material, or any combination thereof. The first ends of the lifting lines can be configured to be connected to the second ends 123, 124 of the link arms 117, 118, the couplers 123, 124 that can be connected to the second ends 123, 124 of the link arms 117, 118, and/or to the first component of the releasable connectors 127, 128 that can connected to the second ends 123, 124 and/or the couplers 123, 124. In some embodiments, a buoy can be disposed on the second ends of the lifting lines such that the second ends of the lifting lines float on the surface 102 of the body of water 103 when the yoke mooring system 100 is disconnected from the vessel 101 so that the lifting lines can be readily retrieved upon return of the vessel 101.

The yoke mooring system 100 can also include at least one lifting device that can be configured to lift and lower a corresponding link arm. In some embodiments, as shown, the yoke mooring system 100 can include a first lifting device 134 and a second lifting device 135 that can be configured to lift and lower the first and second link arms 117, 118, respectively. The lifting devices 134, 135 can independently be or include, but are not limited to, a lifting device that utilizes a linear moving mechanism, a rotary torque mechanism, or a combination thereof. Suitable lifting devices that utilize a linear moving mechanism can be or can include, but are not limited to, chain jacks, strand jacks, linear winches, or the like. Suitable lifting devices that utilize a rotary torque mechanism can be or can include, but are not limited to, rotary winches that include one or more drums, e.g., single drum rotary winches or two drum rotary winches, a powered windlass, or the like. The windlass typically includes a chain wheel that includes, e.g., seven pockets, that can grip a chain, but the chain does not roll up on a drum but instead is moved off or onto the chain wheel as the chain is pulled in or let out. The lifting devices that utilize the linear moving mechanism can be powered via an internal combustion engine-hydraulic power unit or an electric hydraulic power unit. The lifting devices that utilize the rotary torque mechanism can be powered via electricity, hydraulics, an internal combustion engine, or combination thereof.

In some embodiments the lifting devices 134, 135 can be configured such that a speed at which the lifting devices 134, 135 operate at can be tuned, adjusted, or otherwise correlated to account for a motion of the vessel that can be caused by wind, waves, swell, and/or current present at a given mooring location. In some embodiments, the lifting devices 134, 135 can be configured such that a speed at which the lifting devices 134, 135 operate at is not tuned, adjusted, or otherwise correlated to account for a motion of the vessel. Said another way, the lifting devices 134, 135 can be configured to lift and lower the first and second link arms 117, 118 and the yoke 109 and the ballast tank 116 at a speed that is independent from a motion of the vessel.

Figure 5:
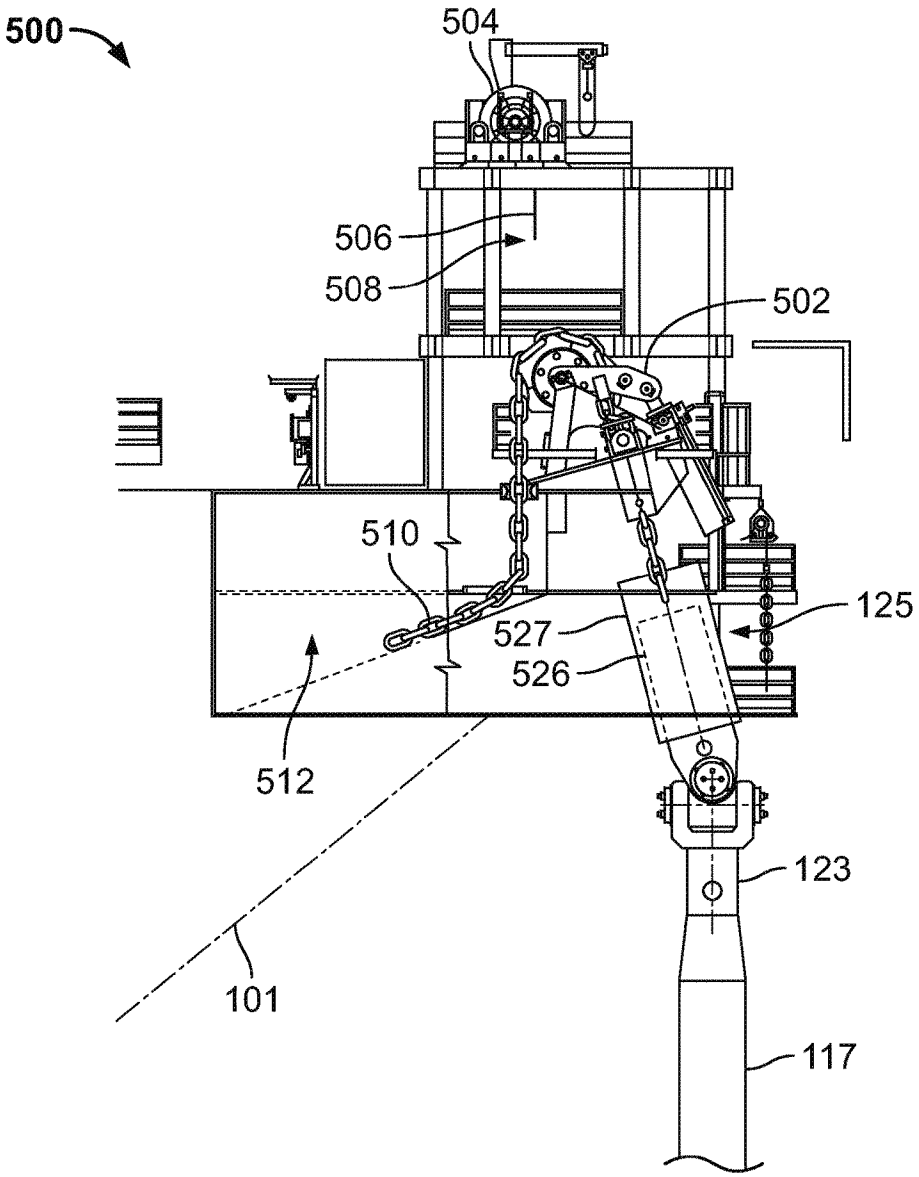
FIG. 5 depict a side elevation partial cross-sectional view of an illustrative lifting arrangement that includes a chain jack and a rotary winch of for use in connecting and disconnecting a yoke mooring system, according to one or more embodiments described.

FIG. 5 depict a side elevation view of an illustrative lifting device 500 that can include a chain jack 502 and a rotary winch 504 for use in connecting and disconnecting the yoke mooring systems 100, 200, 900, and/or 1000 described herein, according to one or more embodiments. In some embodiments, the lifting device 500 can be disposed on a bow or a stern of the vessel. In some embodiments, a first and a second lifting device 500 can be configured to lift the first and second link arms 117, 118, respectively, along with the yoke 109 and the ballast tank 116 from a position where the yoke 109 and the ballast tank 116 are resting on the seabed 105 or a landing structure, e.g., a mud mat or fenders located on the seabed 105, to a position at which the ballast tank 116 and the link arms 117, 118 can be suspended from the vessel 101 via connection with the releasable connector 125. As shown, a first component 526 of the releasable connector 125 connected to the link arm 117 can be secured to a second component 527 of the releasable connector 125 that can be disposed on the vessel 101. The first and second lifting devices 500 can also be configured to lower one of the link arms 117, 118 along with the yoke 109 and the ballast tank 116 from the suspended position to a position where the yoke 109, the ballast tank 116, and the link arms 117, 118 are resting on the seabed 105 or resting on the optional landing structure.

In some embodiments, the first lifting device 500 can include a first rotary winch 504 and a first chain jack 502 that can be configured to lift and lower the first link arm 117 and at least a portion of the yoke 109 and the ballast tank 116. Another or second lifting device 500 can also be configured to lift and lower the second link arm 118 and at least a portion of the yoke 109 and the ballast tank 116. In some embodiments, the first two lifting devices, i.e., the first and second rotary winches 504, of the first and second lifting devices 500 can be configured to lift or lower the link arms 117, 118 and the second two lifting devices, i.e., the first and second chain jacks 502, of the first and second lifting devices 500 can be configured to lift or lower the yoke 109 and the ballast tank 116 along with the link arms 117, 118.

As noted above, the yoke mooring system 100 (as well as 200, 900, and 1000) can also include at least one lifting line. As shown in FIG. 5, the lifting line can include two segments coupled together. More particularly, the first segment 506 can be connected at a second end to the rotary winch 504 and a first end 508 thereof to a second end of the second segment 510 when the first segment 506 pulls in the second segment 510 via the rotary winch 504 into engagement with the chain jack 502. As shown, the second segment 506 has engaged the chain jack and, as such, the first end of the first segment 506 has been disconnected therefrom to allow the second segment 506 to be conveyed into a storage compartment 512 configured to receive the second segment 510. When the lifting device 500 includes the chain jack 502 the second segment 510 can be a chain. The first end of the second segment 506 can be configured to be connected to the second ends 123, 124 of the link arms 117, 118, the couplers 127, 128 that can be connected to the second ends 123, 124 of the link arms 117, 118, and/or to the first component of the releasable connectors 125, 126 that can be connected to the second ends 123, 124 and/or the couplers 127, 128. In other embodiments, when the lifting device 500 includes a strand jack or a linear winch, the second segment 510 can be a cable, a wire, or the like.

In some embodiments, the second ends of the first segment 506 can each be connected to a first end of a corresponding retrieval line with each retrieval line having a buoy disposed or otherwise connected to the second end thereof such that the second ends of the retrieval line remain at the surface 102 of the body of water 103 when the vessel 101 is disconnected from the yoke mooring system 100, 200, 900, 1000. In some embodiments, the retrieval lines can be lighter in weight, e.g., a cable, as compared to the lifting lines connected thereto that can be greater in weight, e.g., a chain having more mass per linear foot that the retrieval lines. In some embodiments, each retrieval line can be retrieved from the surface 102 of the body of water 103 and routed to a corresponding winch 504. Each winch 504 can be used to haul in the corresponding lifting line 506 until the second end of each second segment 510 is adjacent or proximate to the chain jack 502. The second segment 510 can then be engaged with the chain jack 502 and the chain jack(s) 502 can be used to lift the link arms 117, the yoke 109, and the ballast tank 116 until the first part of the releasable connector 125 can be connected to the second part of the releasable connector for connection of the yoke mooring system to the vessel.

Figure 6:
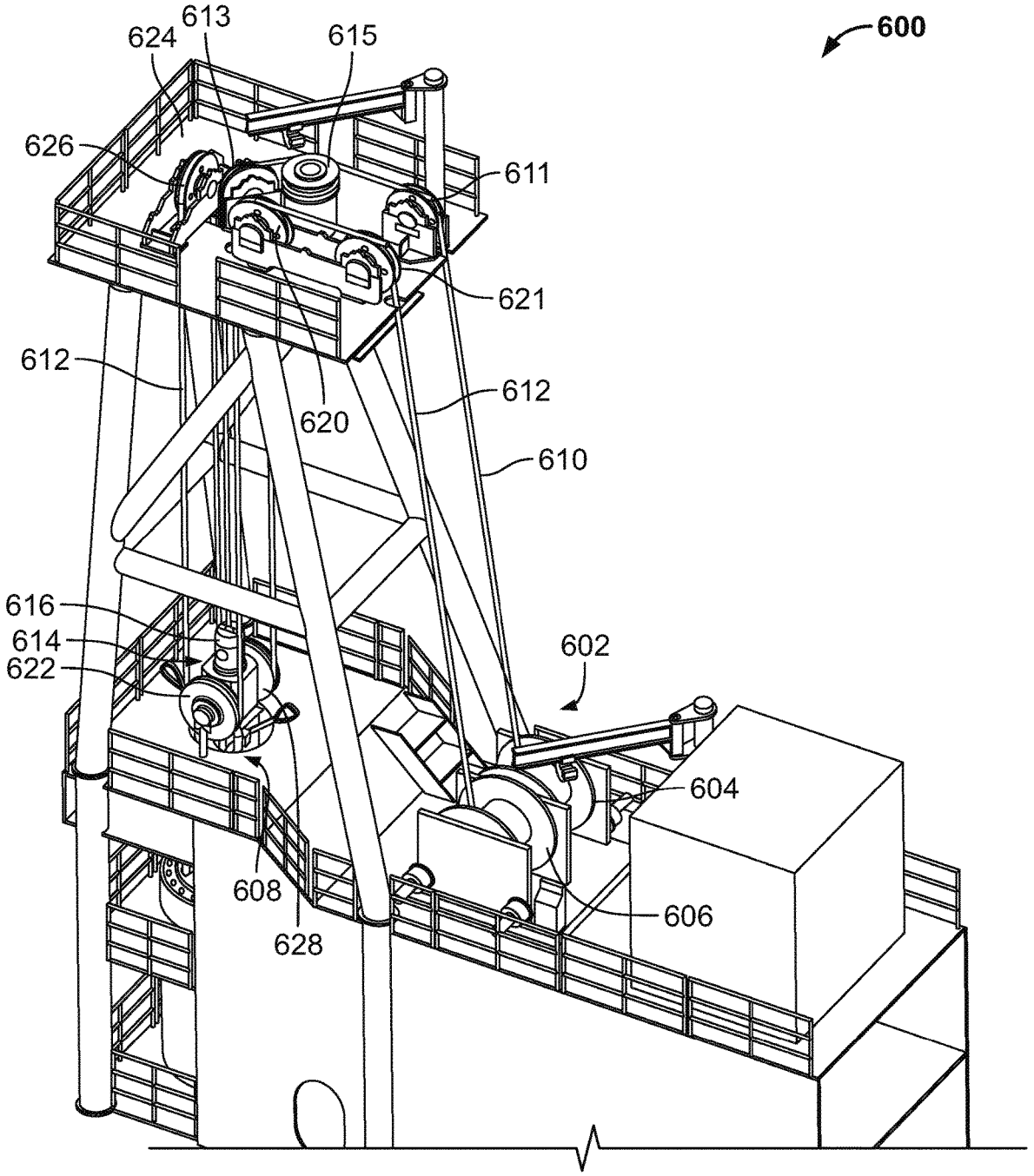
FIG. 6 depicts an isometric view of an illustrative lifting arrangement that includes a rotary winch that includes a first and a second independent drum and a traveling block arrangement for use in connecting and disconnecting a yoke mooring system, according to one or more embodiments described.
Figure 7:
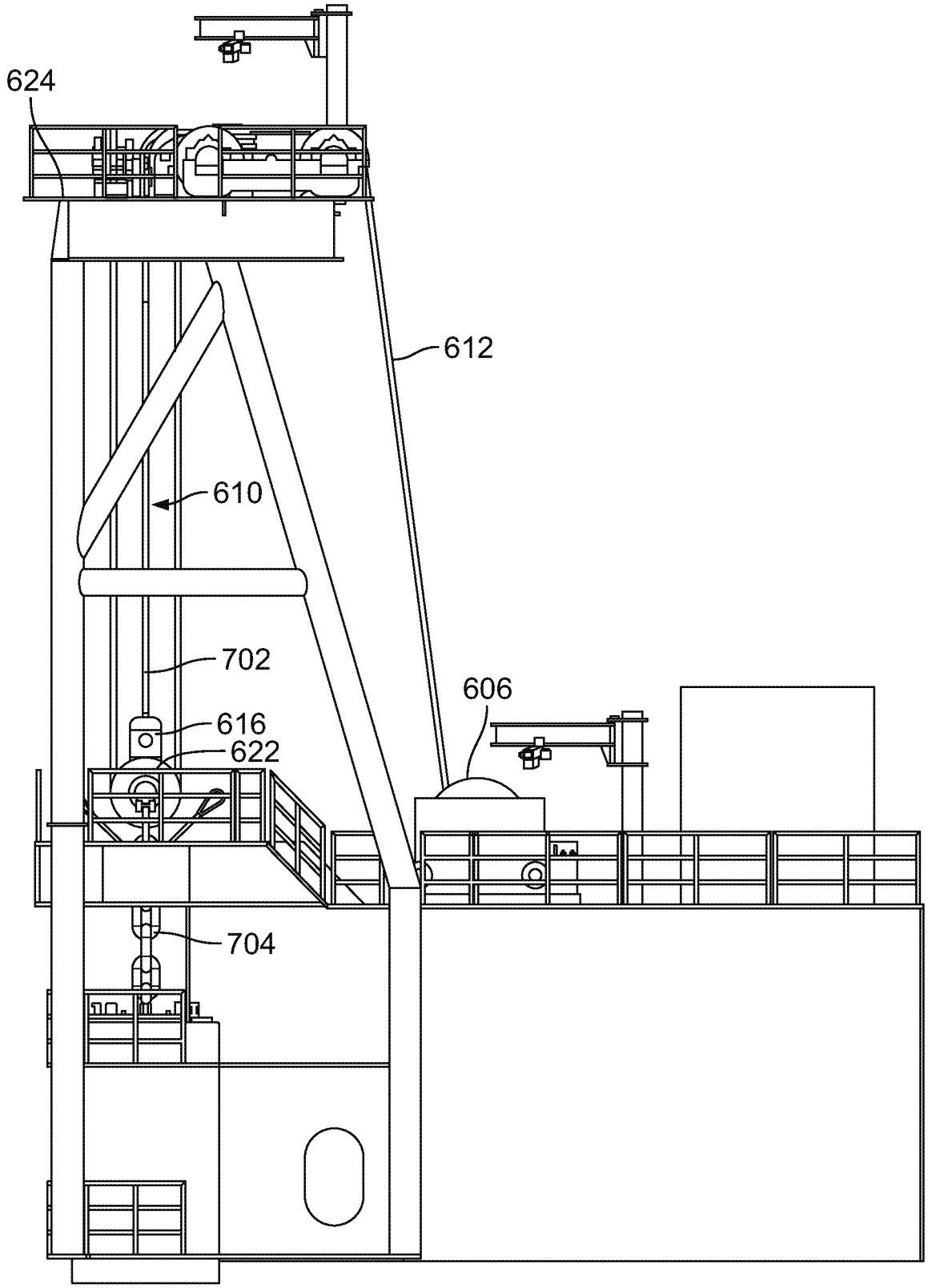
FIG. 7 depicts a side elevation view of the lifting arrangement shown in FIG. 6.
Figure 8:
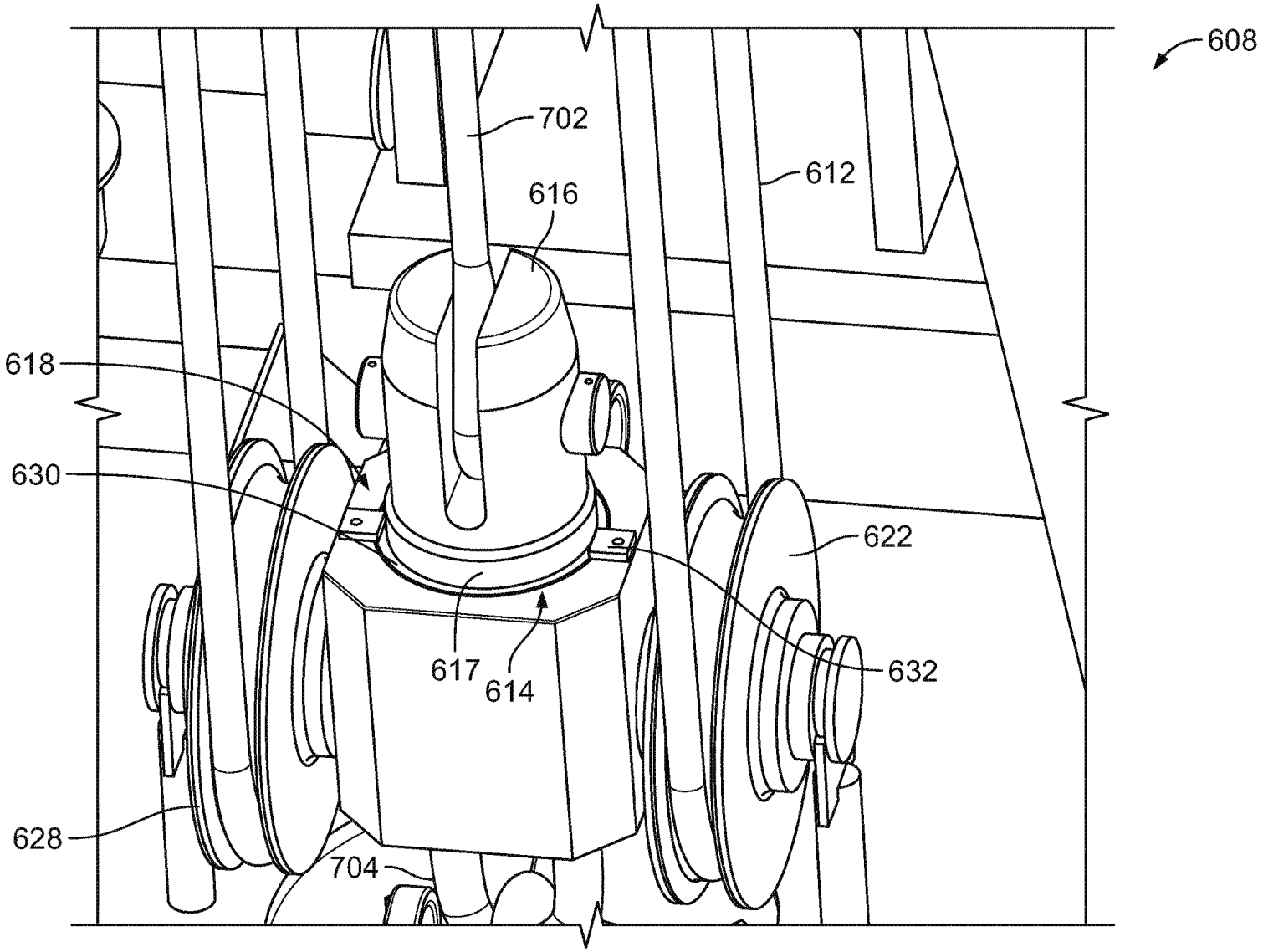
FIG. 8 depicts an isometric close-up view of a traveling block arrangement shown in FIGS. 6 and 7.

FIG. 6-8 depict an isometric, a side elevation, and an isometric close-up view, respectively of an illustrative lifting device 600 that includes a rotary winch 602 that can include a first and a second independent drum 604, 606 and a traveling block 608 for use in connecting and disconnecting the yoke mooring system 100, 200, 900, and/or 1000, according to one or more embodiments. The lifting device 600 can include a lifting line 610 and a hoisting line 612. A first end of the lifting line 610 can be attached to the second end of a corresponding link arm, e.g., link arm 117, and a second end of the lifting line 610 can be attached to the first independent drum 604 of the rotary winch 602. As shown, the lifting line 610 can be routed over one or more sheaves (two are shown, 611, 613) and against one or more sheaves 615 disposed on the top of a deck 624.

The lifting line 610 can include connector 616 disposed between the first end and the second end thereof. In some embodiments, the connector 616 can include a mating surface 614. In some embodiments, the mating surface 614 can be an exterior surface of a bull nose, as shown, or a link of a chain, a padeye, a clevis, a lug having a bore therethrough, or any other surface capable of mating or otherwise being secured to a receptacle 618 of the traveling block 608. As shown, the receptacle 618 can be or can include a bore or other opening defined by and through the traveling block 608 into which the connector 616 can be moved into.

In some embodiments, the lifting line 610 can further include a float line attached at a first end thereof to the second end of the lifting line 610 and a buoy can be disposed at a second end of the float line such that the second end of the float line floats on the surface 102 of the body of water 103 when the yoke mooring system 100, 200, 900, and/or 1000 is disconnected from the vessel 101 so that it can be readily retrieved to the vessel 101 prior to connecting the yoke mooring system to the vessel 101. The float line can be a synthetic rope, a wire rope, natural rope, a cable, a chain, or other suitable elongated member. The lifting line 610 can be a wire rope, a synthetic rope, natural rope, a cable, a chain, any other suitable elongated member, or any combination thereof. As shown, the lifting line 610 can include a first segment 702 and a second segment 704 connected thereto via the connector 616 (see FIG. 7). In some embodiments, the first segment 702 can be a rope or a cable and the second segment 704 can be a chain. In some embodiments, the buoy can be disposed at the second end of the first lifting line 610 and the float line can be excluded. In some embodiments, the rotary winch 602 can be configured as two independent rotary winches rather than a rotary winch that includes the first and second independent drums 604, 606.

In some embodiments, a first end of the hoisting line 612 can be connected to the second independent drum 606 of the rotary winch 602, the hoisting line 612 can be reeved or routed around a first sheave 620 or reeved or routed over another sheave 621 located between the second independent drum 606 and the first sheave 620 (as shown) and reeved or routed over the first sheave 620 disposed above the traveling block 608, reeved or routed around a second sheave 622 disposed on the traveling block 608, and connected at a second end thereof at a point on the vessel located above the traveling block 608, e.g., an underside of the deck 624. In other embodiments, the first end of the hoisting line 612 can be connected to the second independent drum 606 of the rotary winch 602, the hoisting line 612 can be reeved or routed around the first sheave 620 or reeved or routed over another sheave 621 located between the second independent drum 606 and the first sheave 620 and reeved or routed over the first sheave 620 disposed above the traveling block 608, reeved or routed around the second sheave 622 disposed on the traveling block 608, reeved or routed around a third sheave 626 disposed above the traveling block 608, reeved or routed around a fourth sheave 628 disposed on the traveling block 608, and connected at the second end thereof at a point on the vessel located above the traveling block 608, e.g., an underside of the deck 624.

When the lifting device 600 includes the first, second, third, and fourth sheaves 620, 622, 626, 628, as shown, the lifting device 600 includes a four-part lifting arrangement that can provide a 4:1 mechanical advantage that can allow the rotary winch 602 to have a lower or reduced pulling capacity. In some embodiments a two-part, a three-part, a five-part, a six-part, a seven-part, an eight-part part or more lifting arrangement can be implemented depending, at least in part, on a desired size of the rotary winch 602 and/or a weight of the yoke 109 and the ballast tank 116. In some embodiments, the arrangement of the traveling block 608 and the fixed sheaves (disposed above the traveling block 608) and the traveling sheaves (disposed on the traveling block 608) can provide at least a 3:1 or at least a 4:1 to a 5:1, a 6:1, a 7:1, an 8:1, a 9:1, a 10:1 or greater mechanical advantage.

In operation, the lifting line 610 or the optional float line connected thereto can be retrieved from the surface of the body of water, the second end of the lifting line 610 can be connected to the first drum 604 of the rotary winch 602. The rotary winch 602 can pull the lifting line 610 in until the link arm 117 has been lifted and the mating surface 614 has engaged with and been secured in the receptacle 618 defined by the traveling block 608. In some embodiments, the connector 616 can define an outer shoulder 617 that includes the mating surface 614 that can be retained within the receptacle 618 of the traveling block 608 via a split ring 630 and one or more retainer plates (two are shown, 632). In other embodiments, the connector 616 can be secured to the receptacle 618 of the traveling block 608 via a hydraulic actuator, or any other connection mechanism as will be apparent to those skilled in the art. In some embodiments, once the connector 616 has been connected to the traveling block 608, the lifting line 610 can be released and the load can be taken by the hoisting line 612 and the second drum 606 of the rotary winch 602. In other embodiments, the first and second independent drums 604, 606 of the rotary winch 602 can be used together to lift the lifting line 610 and the hoisting line 612, respectively. The hoisting line or the hoisting line and the lifting line 610 can be used to lift the link arm 117 and a portion of the yoke 109 and the ballast tank 116 until the first part of the releasable connector 125 can be connected to the second part of the releasable connector 125, thus connecting the vessel 101 to the yoke mooring system 100, 200, 900, and/or 1000.

Figure 9:
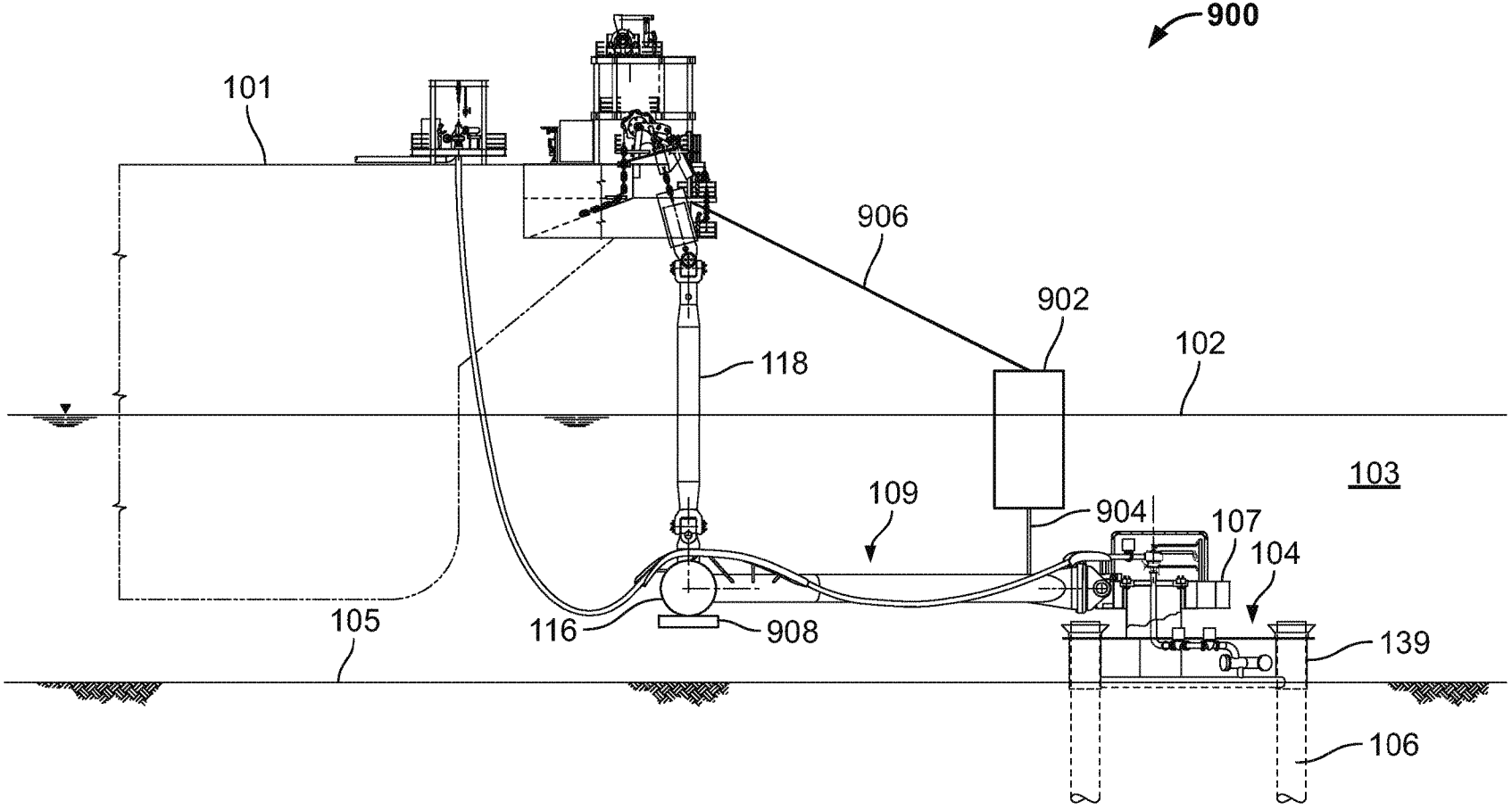
FIG. 9 depicts a side elevation view of an illustrative disconnectable yoke mooring system that includes a mooring buoy configured to assist with connection and disconnection operations of the yoke mooring system, according to one or more embodiments described.

FIG. 9 depicts a side elevation view of an illustrative disconnectable yoke mooring system 900 that includes a mooring buoy 902 configured to assist with connection and disconnection operations of the yoke mooring system 900 to and from the vessel 101, according to one or more embodiments. In some embodiments, the mooring buoy 902 can be connected to the yoke 109, the turntable 107, and/or the ballast tank 116. In some embodiments, the mooring buoy 902 can float on the surface 102 of the body of water 103. In other embodiments, the mooring buoy 902 can float in the body of water 103 below the surface of the body of water 103. The mooring buoy 902 can be used to assist with mooring operations and, in particular, heading control of the vessel 101 during the connection process and can be included in any of the embodiments described herein.

In some embodiments, the mooring buoy 902 can be a steel buoy with a tether 904 connecting the mooring buoy 902 to the yoke 109, the turntable 107, and/or the ballast tank 116. The mooring buoy 902 can include a padeye, a hook or other attachment point to attach a mooring line, hawser or other rope 906 from the mooring buoy 902 to the vessel 101. In this way, the vessel 101 can be moored to the yoke mooring system 900 during the connection process and thus reduce or eliminate the number of tug boats or other secondary vessels for the purposes of heading control of the vessel 101 during the connection process or even eliminate the need for tug boats for the purposes of heading control of the vessel 101 during the connection process. The vessel can also be connected to the mooring buoy 902 prior to the disconnection process for the purposes of heading control.

In some embodiments, the yoke mooring system 900 can also include a mudmat, one or more fenders, or other landing structure(s) 908 integrated with the ballast tank 116 and/or the yoke 109. The landing structure can provide a surface for the yoke 109 and/or the ballast tank 116 to rest on such that the yoke 109 or the ballast tank 116 does not get stuck or adhere to the seabed 105 which is possible as some seabeds can often have a very soft, muddy consistency. In some embodiments, if the yoke mooring system 900 includes the landing structure 908, the landing structure 908 can be at least partially disposed on a bottom surface of the ballast tank 116.

Figure 10:
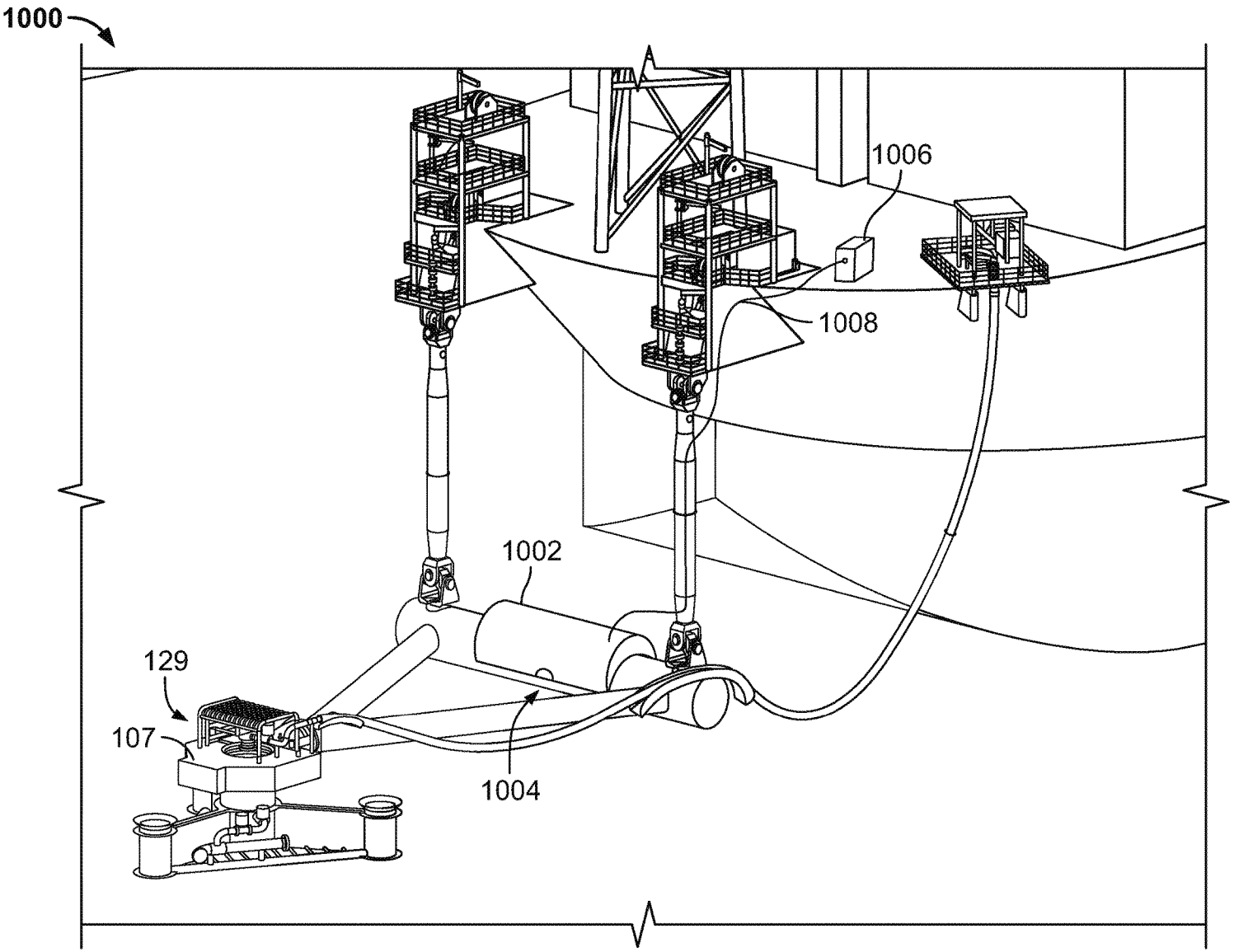
FIG. 10 depicts an isometric view of another illustrative disconnectable yoke mooring system that includes a buoyancy module disposed on a yoke of the mooring system, according to one or more embodiments described.

FIG. 10 depicts an isometric view of another illustrative disconnectable yoke mooring system 1000 that includes a buoyancy module 1002 disposed on the yoke 109 of the mooring system 1000, according to one or more embodiments. In some embodiments, the buoyancy module 1002 can be disposed on the ballast tank 116, as shown. In other embodiments, the buoyancy module can be disposed between the second end 111 of the yoke 109 and the first end 110 of the yoke 109. In some embodiments, the yoke mooring system 1000 can include, one, two, three, four, or more buoyancy modules 1002. The buoyancy module(s) 1002 can be configured to reduce the weight of the yoke 109 and ballast tank 116 by 10%, 20%, or 50% to 75%, 80%, 100%, or even more. By reducing the weight of the yoke 109 and ballast tank 116, the corresponding size and cost of the lifting devices, e.g., 500 and/or 600 disposed on the vessel 101 and used to raise and lower the yoke mooring system 1000 during connection and disconnection from the vessel 101 can be significantly reduced.

In some embodiments, each buoyancy module 1002 can be configured as a soft, flexible bladder, a series of soft, flexible bladders or as a rigid fabricated structure that can be pressure balanced with the pressure in the body of water 103 at the exterior of the buoyancy module 1002. In some embodiments, the buoyancy module 1002 can be open via one or more ports or openings 1004 to the body of water 1003 at a position that is toward the bottom of the buoyancy module 1002. The buoyancy module 1002 can normally be filled with water such that the weight of the yoke mooring system 1000 is a maximum and can be filled with a liquid, a gas, or a combination of a liquid and a gas prior to the disconnection or reconnection of the vessel 101 from or to the yoke mooring system 1000 such that the weight of the yoke mooring system 1000 can be reduced. In this way, the dimensions, size, and/or capacity of the lifting devices, e.g., 500 and/or 600, and the corresponding lifting lines can be reduced.

In some embodiments, the buoyancy module 1002 can be in fluid communication with a compressed fluid source 1006. The compressed fluid source can be disposed on the vessel 101 or an auxiliary or second vessel. In some embodiments, the compressed fluid source 1006 can be a compressor or a bank of compressed gas cylinders. The compressed fluid can be air, nitrogen, exhaust gas, or any other gas or mixture of gases. The compressed fluid source 1006 can be in fluid communication with the buoyancy module 1002 via a compressed fluid conduit 1008. The compressed fluid conduit can be a stand-alone flexible pipe, hose, or other similar type of conduit. The compressed fluid conduit can also be disposed within a control umbilical that can run from the vessel 101 to the turntable 107 and through the fluid swivel 129.

In some embodiments, the amount of fluid introduced inside of the buoyancy module 1002 can be selected such that the yoke 109 and the ballast tank 116 are stable resting on the seabed during a severe weather period after the vessel 101 has been disconnected. In some embodiments, the amount of fluid within the buoyancy tank 1002 can be reduced after the yoke 109 and the ballast tank 116 have been set onto the seabed 105 thereby increasing the weight of the yoke 109 and the ballast tank 116 after disconnection to provide additional stability. In some embodiments, the fluid via line 1008 can be introduced into the buoyancy module 1002 prior to reconnecting the vessel 101 to the yoke mooring system 1000. In some embodiments, the fluid can be introduced into the buoyancy module 1002 one time prior to a severe weather season and the fluid can be expelled from the buoyancy module 1002 upon the passing or completion of the severe weather season, e.g., prior to a hurricane or typhoon season and after a hurricane or typhoon season.

Figure 11:
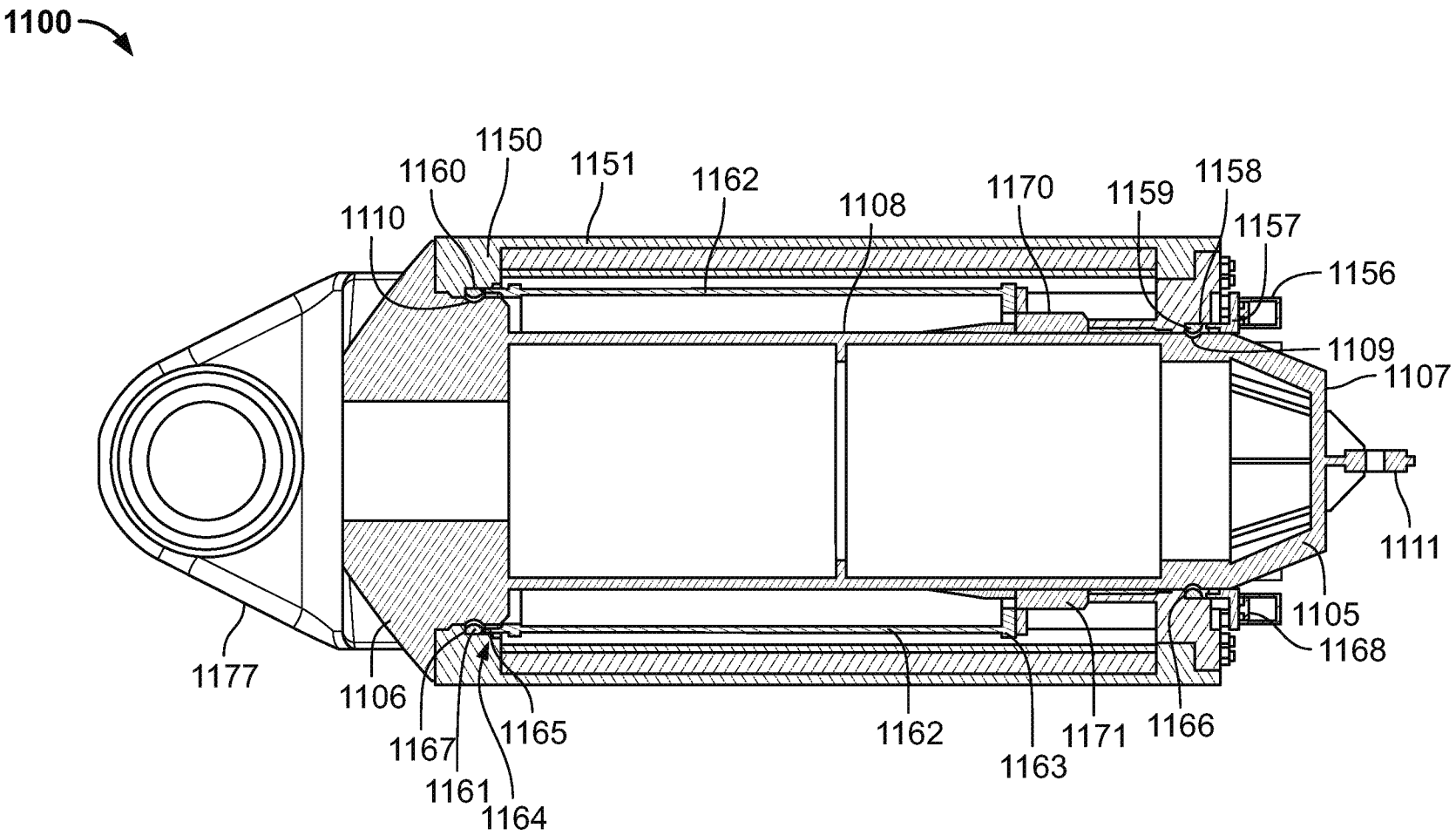
FIGS. 11 and 12 depict a cross-sectional elevation view of an illustrative releasable connector in an unlocked and a locked position, respectively, according to one or more embodiments described.
Figure 12:
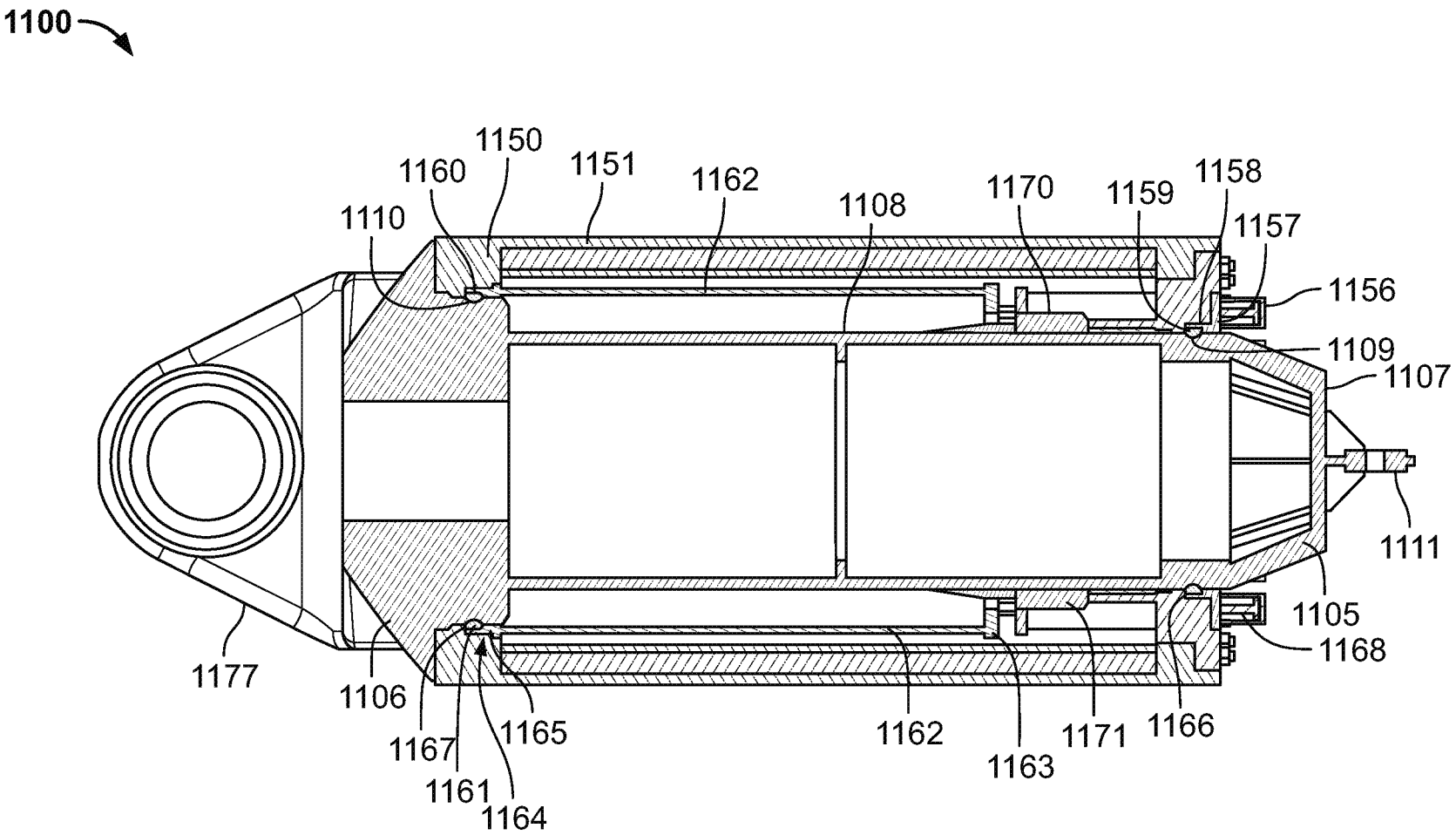

FIGS. 11 and 12 depict a cross-sectional elevation view of an illustrative releasable connector 1100 in an unlocked and a locked position, respectively, according to one or more embodiments. In some embodiments, the releasable connector 1100 can include a stinger 1105 and a sleeve assembly 1150, where the stinger 1105 can be secured within the sleeve assembly 1150. The stinger 1105 can have a first end 1106 and a second end 1107. The first end 1107 can be connected to the second end of a link arm, e.g., link arm 117, or can be connected to a component 1127 of the coupler 127, as shown. The second end 1107 of the stinger can be coupled to a lifting line, e.g., lifting line 610. In some embodiments, an optional connector structure 1111, e.g., a padeye, a clevis, a trunnion, or the like, can be disposed on the first end 1107 of the stinger 1105. As such, in some embodiments, the lifting line connected to the second end 1107 of the stinger 1105, e.g., via the connector structure 1111, can pass through the sleeve assembly 1150 when the stinger 1105 is inserted into or removed from the sleeve assembly 1150.

In some embodiments, the stinger 1105 can have a generally cylindrical outer surface 1108. The stinger 1105 can define a first groove 1109 and a second groove 1110 about at least a portion of the outer surface 1108 of the stinger 1105. In some embodiments, the first groove 1109 and/or the second groove 1110 can extend about 50% or more, 60% or more, 70% or more, 75% or more 80% or more, 90% or more, or 95% or more of the outer surface 1108 of the stinger 1105. In some embodiments, the first groove 1109 and/or the second groove 1110 can be circumferential grooves that extend all the way around the outer surface 1108 of the stinger 1105. In some embodiments, the first groove 1109 can be disposed toward the second end 1107 of the stinger 1105 and the second groove 1110 can be disposed toward the first end 1106 of the stinger. It should be understood that the first and second grooves 1109, 1110 can be located at any desired position between the first end 1106 and the second end 1107 of the stinger 1105. In some embodiments, an outer diameter of the second groove 1110 can be less than an outer diameter of the first groove 1109. Said another way, the outer diameter of the stinger 1105 where the first groove 1109 is defined toward the second end 1107 thereof can be less than the outer diameter of the stinger 1105 where the second groove 1110 is defined toward the first end 1106 thereof.

The sleeve assembly 1150 can include an outer housing 1151. In some embodiments, the outer housing 1151 can have a substantially cylindrical outer surface that can have a bore therethrough within which components of the sleeve assembly 1150 can be at least partially disposed. In other embodiments, however, the outer housing 1151 of the sleeve assembly 1150 can have any desired geometrical cross-sectional shape or combination of cross-sectional shapes. For example, the outer housing 1151 of the sleeve assembly 1150 can have a cross-sectional shape that can be triangular, rectangular, circular, pentagonal, hexagonal, or the like, or any combination thereof. The cross-sectional shape(s) of the outer surface of the outer housing 1151 can be configured as desired for a given application. The outer housing 1151 can be configured to be secured to the vessel 101 (see, e.g., FIG. 1), to which the stinger 1105 and a link arm, e.g., 117, coupled to the component 1127 of the connector 127 (or directly to the link arm 117 can be coupled together when the stinger 1105 has been inserted into and secured within the sleeve assembly 1150. Connection systems or methods suitable for securing the outer housing 1151 of the sleeve assembly to the vessel 101 can include, but are not limited to, welding, bolts, bolts and nuts, rivets, pins, screws, mechanical connectors such as a collet connector, adhesives, or the like.

In some embodiments, the sleeve assembly 1150 can be configured to secure the stinger 1105 therein via a latching mechanism. The latching mechanism can include but is not limited to, one or more actuators 1156, a first actuator ring 1157, a first stationary inner wall 1158 disposed toward the second end 1107 of the sleeve assembly 1150, a first split ring 1159, a second stationary inner wall 1160 disposed toward the first end 1106 of the sleeve assembly 1150, a second split ring 1161, a moveable inner wall 1162 having a first end 1163 and a second end 1164, a second actuator ring 1165, and one or more guide rods or connecting members (not shown due to the cross-sectional view. The first split ring 1159 can be disposed on a first shoulder 1166 defined by the first stationary inner wall 1158. The second split ring 1161 can be disposed on a second shoulder 1167 defined by the second stationary inner wall 1160. In some embodiments, the first shoulder 1166 and/or the second shoulder 1167 can be circumferential shoulders in that the first shoulder 1166 and/or the second shoulder 1167 can extend about at least a portion of the first stationary inner wall 1158 and the second stationary inner wall 1160, respectively. The moveable inner wall 1162 can be disposed between the first and second stationary inner walls 1158, 1160. The second actuator ring 1165 can be disposed about at least a portion of a perimeter of the second end 1164 of the moveable inner wall 1162. In some embodiments, the one or more connecting members (not visible) can be coupled to the first actuator ring 1157 and the first end 1163 of the moveable inner wall 1162. In such embodiment, the moveable inner wall 1162 along with the second actuator ring 1165 can simultaneously move with the first actuator ring 1157, e.g., via actuation of the one or more actuators 1156.

The latching mechanism can be operated to move between a first or an unlocked position and a second or locked position by actuating the one or more actuators 1156. The actuators 1156 can be or can include, but are not limited to, hydraulic actuators, pneumatic actuators, electric actuators, or a combination thereof. In some embodiments, the actuators 1156 can be moved from the first or unlocked position to the second or locked position by moving a piston 1168 in a manner that moves the first actuator ring 1157 between the first stationary inner wall 1158 and an outer diameter of the first split ring 1159 with sufficient force to cause the first split ring 1159 to move partially into the first groove 1110 defined by the outer surface 1108 of the stinger 1105. The actuator 1156 can also cause the moveable inner wall 1162 and, as such, the second actuator ring 1165 to move between the second stationary inner wall 1160 and an outer diameter of the second split ring 1161 with sufficient force to cause the second actuator ring 1161 to move partially into the second groove 1109 defined by the outer surface 1108 of the stinger 1105. Once the first and second split rings 1159, 1161 are partially within the first and second grooves 1110, 1109, respectively, the stinger 105 is rigidly connected to the sleeve assembly 150. To disengage or disconnect the stinger 105 from the sleeve assembly 150 the actuators 156 can be moved in a reverse manner as when moved to the second or locked position to allow the stinger 105 to be removed therefrom.

In some embodiments, the second split ring 1161 can be configured to support a greater axial load than the first split ring 1159 when the stinger 1105 is fully positioned within the sleeve assembly 1150 and the latching mechanism is in the locked position. In some embodiments, the first split ring 1159 can be configured to support a greater radial load than the second split ring 1161 when the stinger 1105 is fully positioned within the sleeve assembly 1150 and the latching mechanism is in the second or locked position. In some embodiments, the second split ring 1161 can be configured to support a greater total load than the first split ring 1159 when the stinger 1105 is fully positioned within the sleeve assembly 1150 and the latching mechanism is in the locked position.

In some embodiments, the stinger 1105 can include one or more alignment keys (two are shown, 1170, 1171) disposed on the outer surface 1108 thereof. In some embodiments, the stinger 1105 can include one, two, three, four, or more alignment keys disposed on the outer surface 1115 thereof. The alignment keys 1170, 1171 can each engage a guide surface that can be at least partially disposed within the moveable inner wall 1162 the latching mechanism (not visible in the figure). During insertion of the stinger 1105 into the sleeve assembly 1150 the alignment keys 1170, 1171 can contact the guide surface to rotatively align the stinger 1105 within the sleeve assembly 1150. In some embodiments, the alignment keys 1170, 1171, if present, can be located anywhere on the outer surface 1108 of the stinger 1105 between the first and second grooves 1109, 1110.

In some embodiments, the first and second split rings 1159, 1161 can be multi-sided split rings. In some embodiments, the first and second split rings 1159, 1161 can include five relatively flat sides having the same or different lengths with respect to one another. In other embodiments, the split rings can have any desired cross-sectional shape such as rectangular (sets of opposing sides having the same or different lengths with respect to each set of sides), trapezoidal, e.g., with at least one set of opposing parallel sides, pentagonal, polygonal, e.g., with multiple sides with equal or unequal length, or the like. It should also be understood that the first and second grooves 1109, 1110 can be defined by inner walls that correspond to a cross-sectional shape of the first and second split rings 1159, 1161 such that the first and second grooves 1109, 1110 can receive the first and second split rings 1159, 1161 therein. In some embodiments, a suitable releasable connector 110 can include the releasable connector(s) as described in U.S. Provisional Patent Application No. 63/255,749, filed on Oct. 14, 2021.

Figure 13:
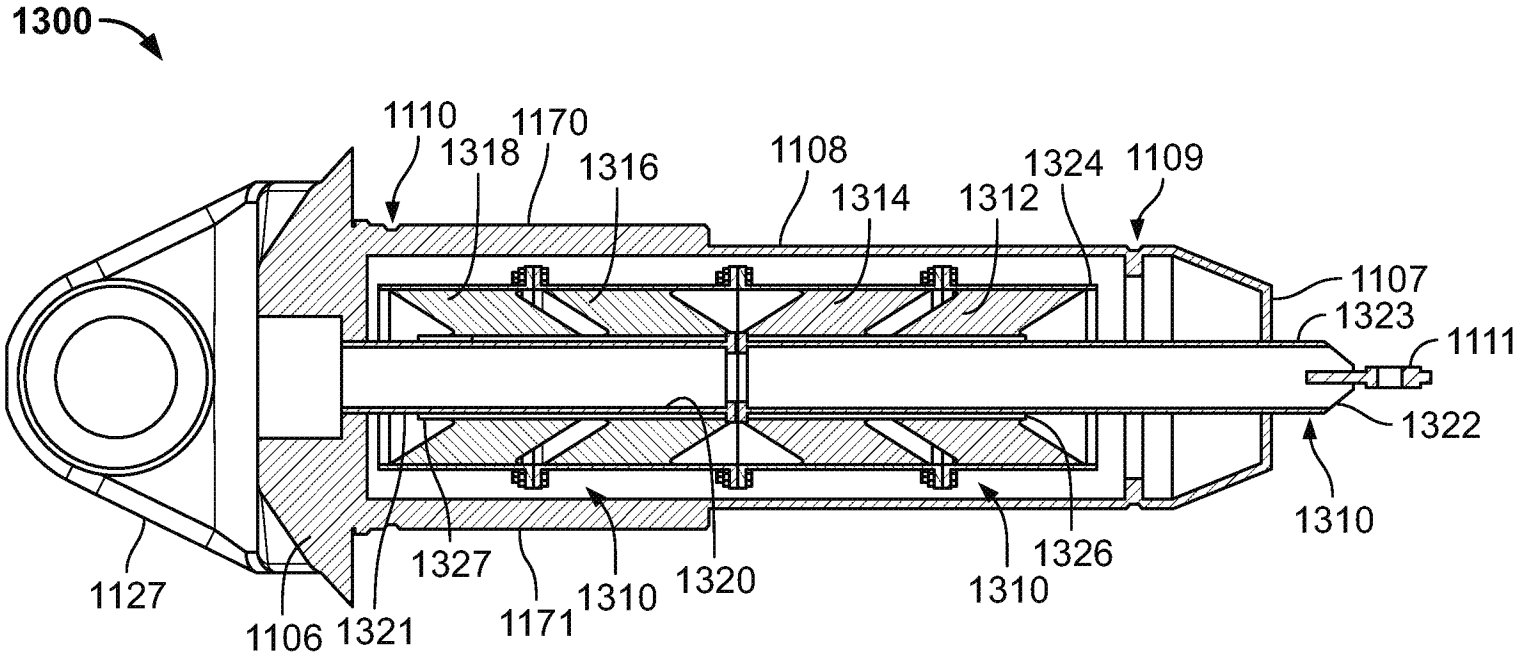
FIGS. 13 and 14 depict a cross-sectional elevation view of an illustrative stinger that can be used in the releasable connector shown in FIGS. 11 and 12 that includes a shock absorber arrangement, according to one or more embodiments described.
Figure 14:
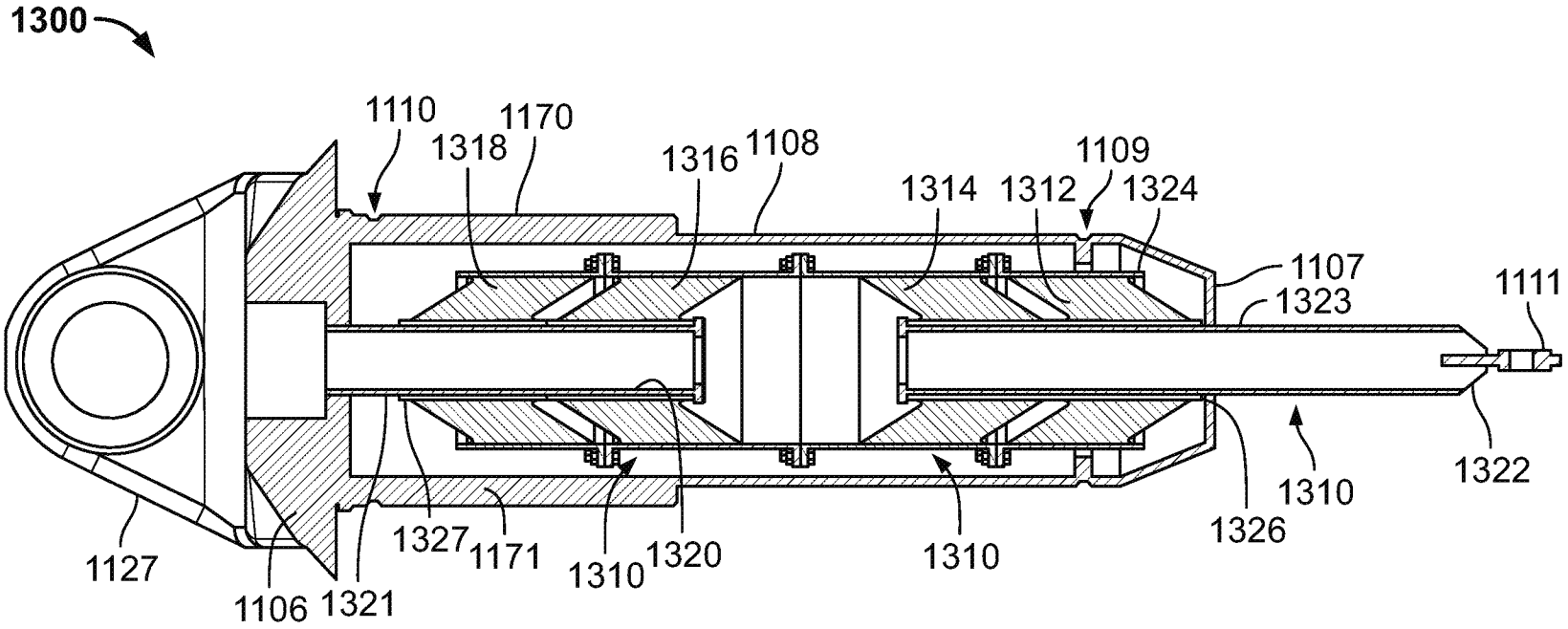
Figure 15:
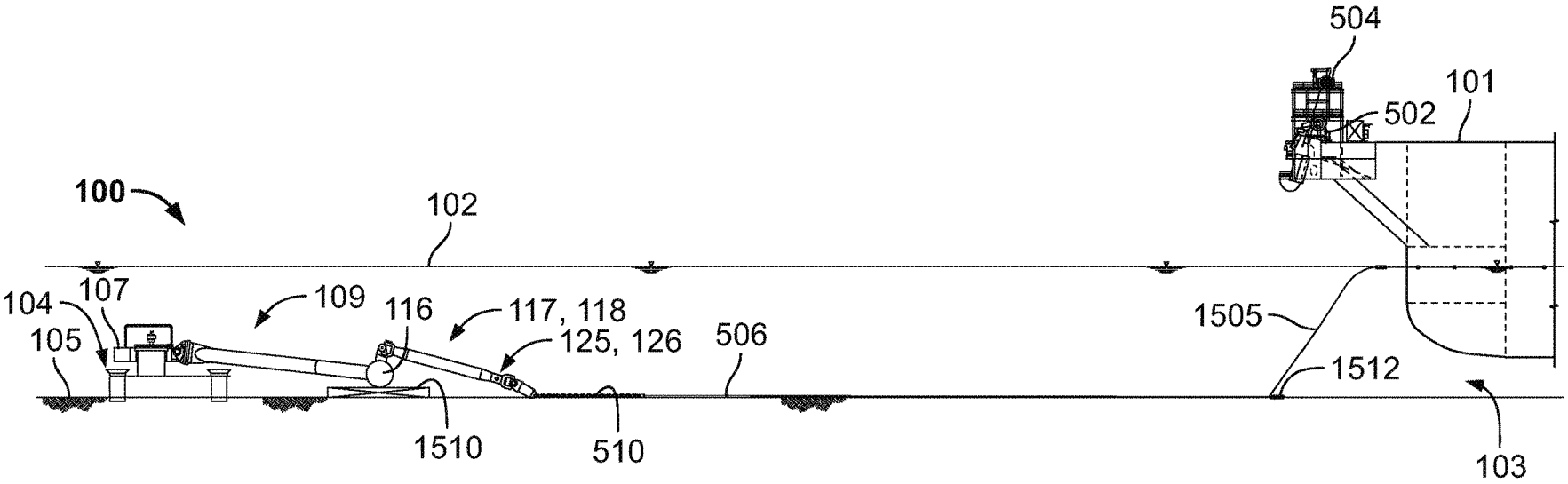
FIGS. 15-20 depict an illustrative connection process connecting a vessel to a disconnectable yoke mooring system, according to one or more embodiments described.
Figure 16:
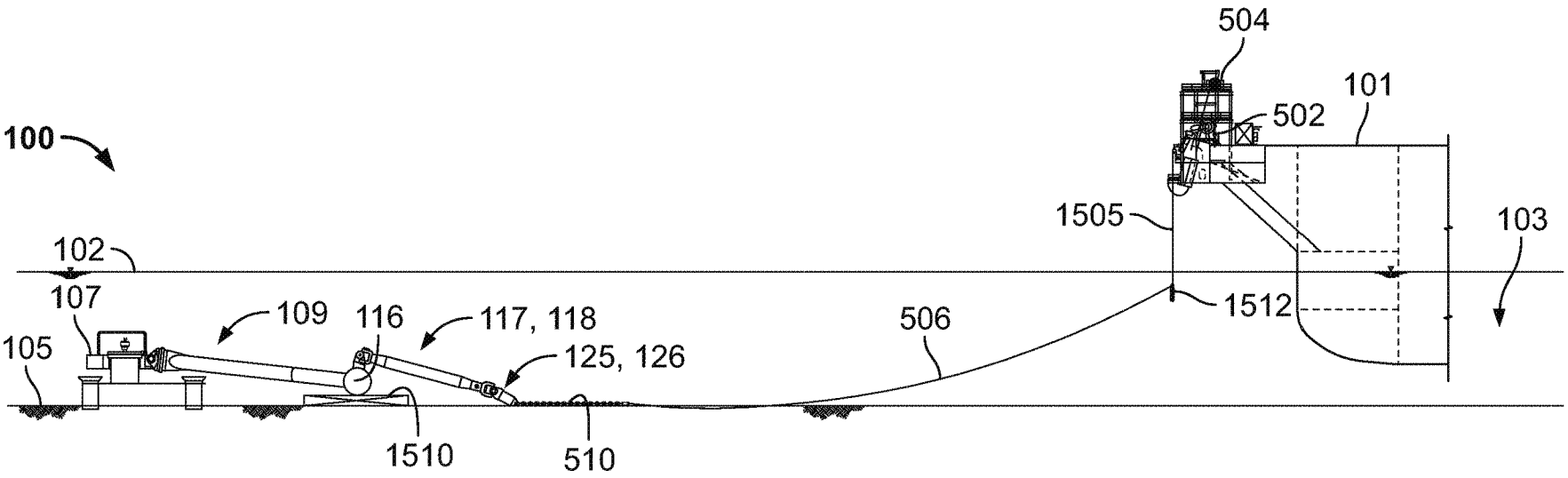
Figure 17:
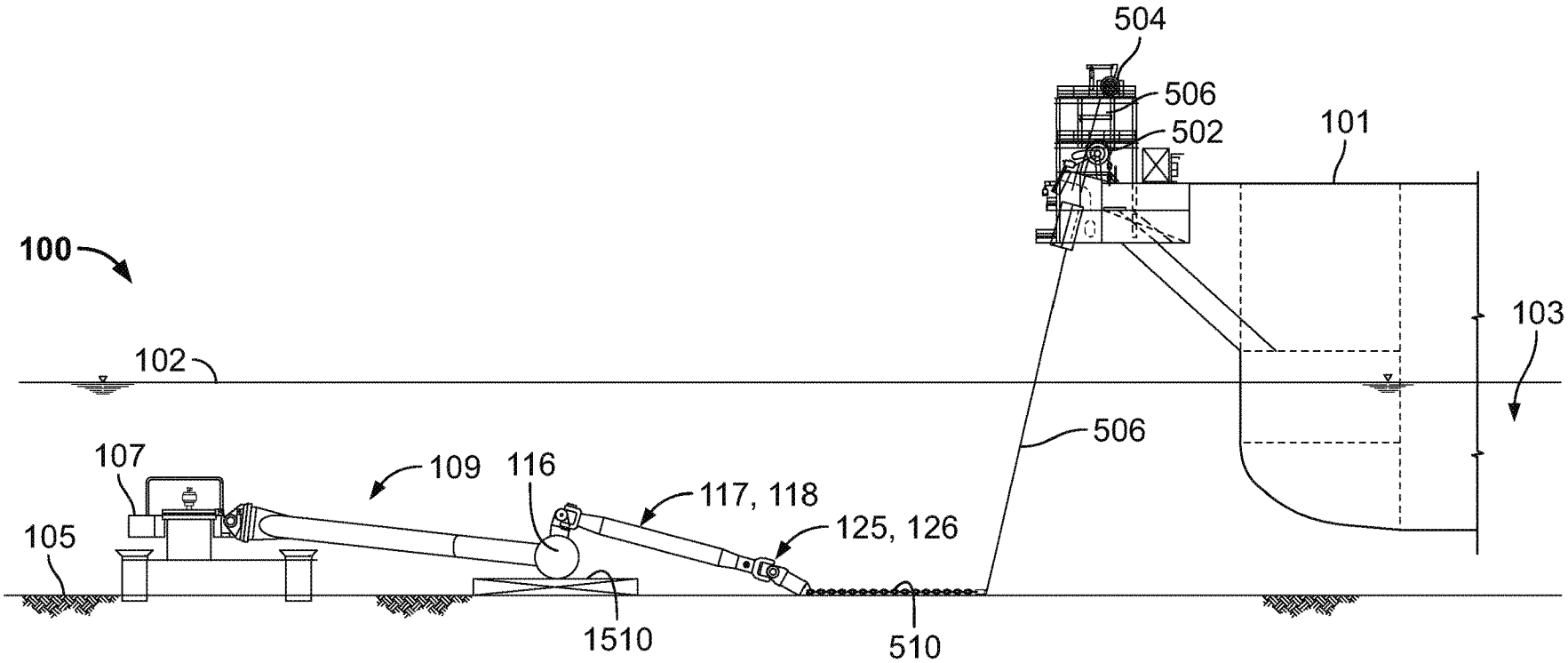
Figure 18:
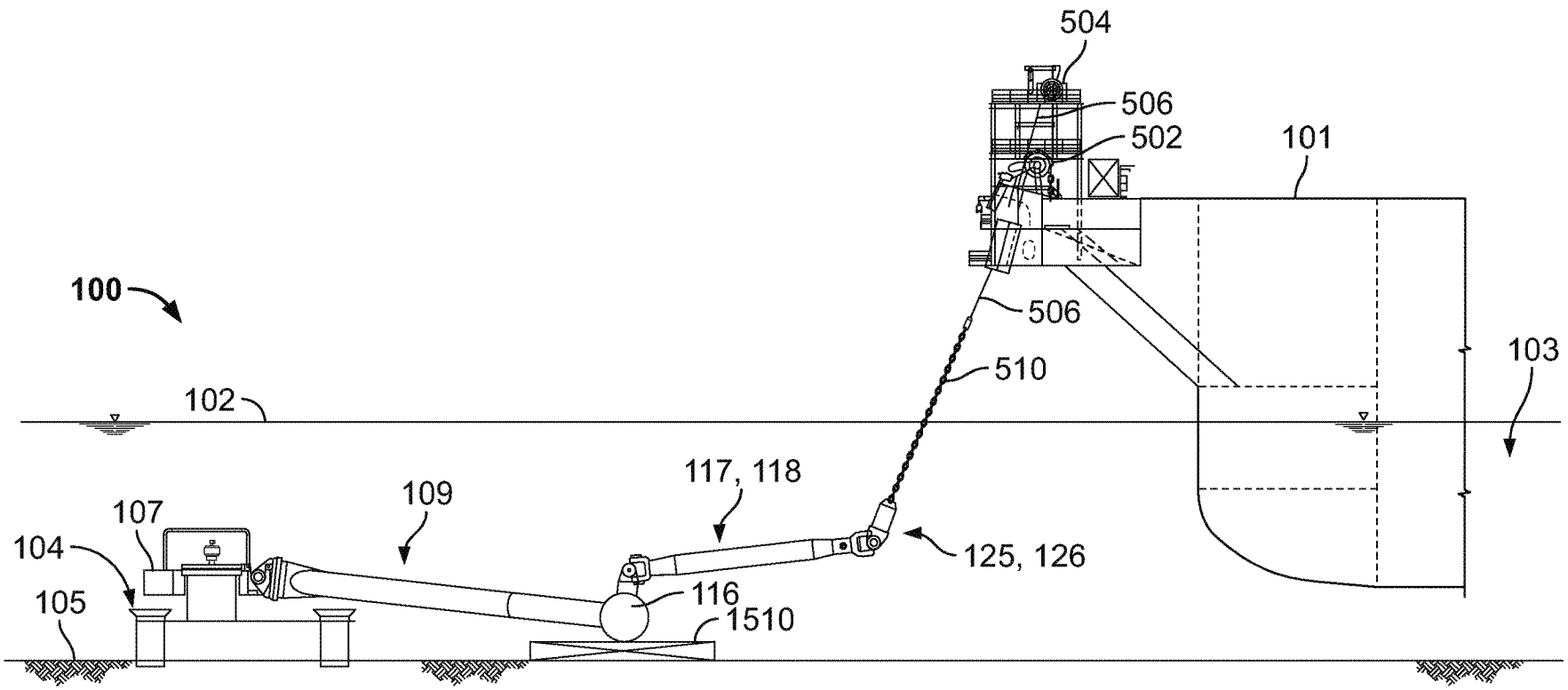
Figure 19:
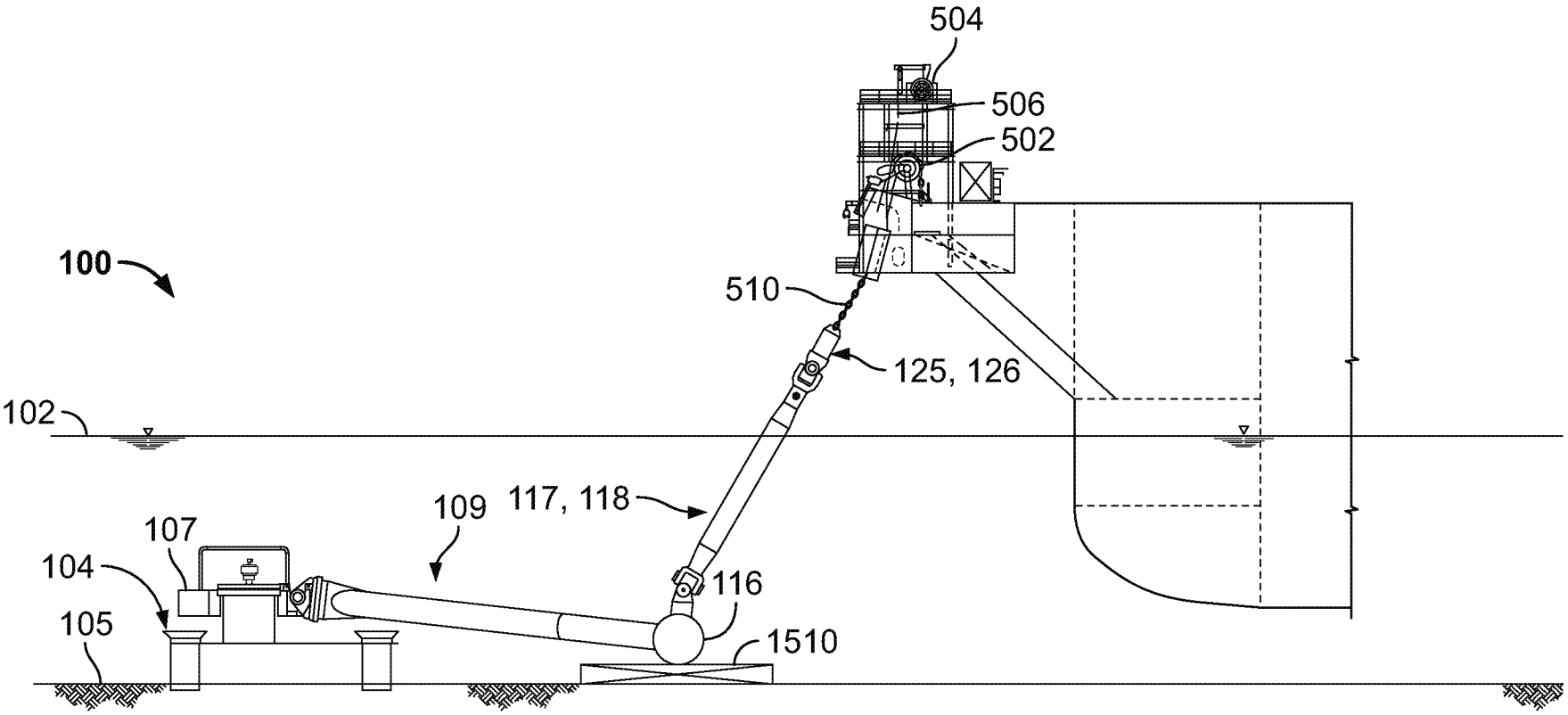
Figure 20:
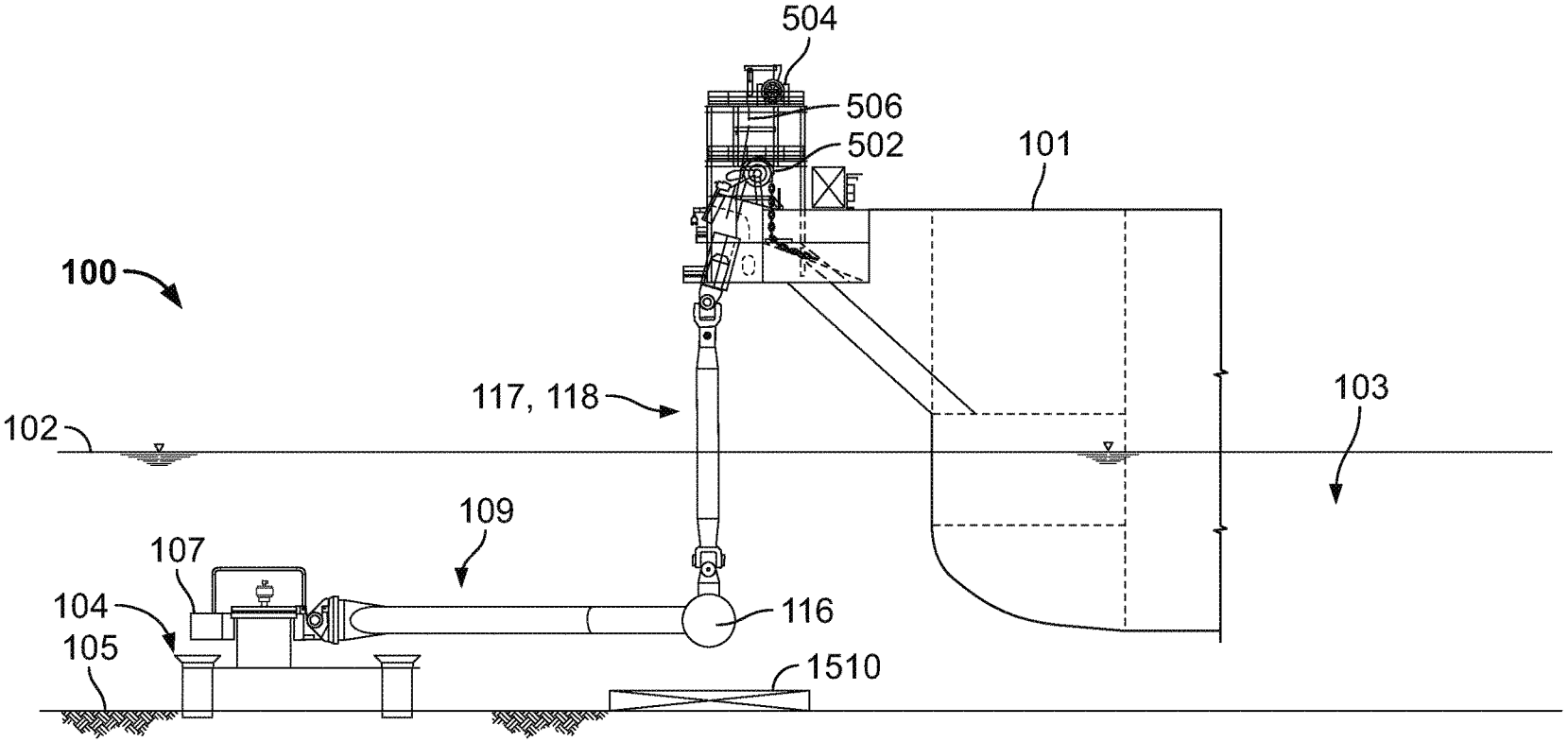

FIGS. 13 and 14 depict a cross-sectional elevation view of an illustrative stinger 1300 that can be used in the releasable connector shown in FIGS. 11 and 12 that includes a shock absorber arrangement 1300, according to one or more embodiments. The stinger 1300 can be similar to the stinger 1105 described above with reference to FIGS. 11 and 12. The main difference is that the stinger 1300 can include a shock absorber arrangement 1310 at least partially disposed therein that can be configured to reduce dynamic loading during connection and disconnection of the stinger 1300 to the sleeve assembly 1150.

In some embodiments, the shock absorber arrangement 1310 can be or can include one or more rubber or elastomeric shock absorber elements (four are shown, 1312, 1314, 1316, and 1318) that can be configured to deform when the stinger 1300 is in a loaded state. In some embodiments, the shock absorber arrangement can be or can include a gas spring with hydraulic damping (not shown). As also shown in FIG. 131, the alignment keys 1170, 1171 can be positioned closer to the second groove 1110 than the first groove 1109 as compared to the stinger 1105.

In addition to the shock absorber elements 1312, 1314, 1316, 1318, the shock absorber arrangement 1310 can also include a fixed member 1320, a moveable member 1322, and a moveable housing 1324. In some embodiments, the shock absorber elements 1312 and 1314 can be coupled to an outer surface 1323 of the moveable member 1322 and an inner surface 1325 of the moveable housing 1324 and the shock absorber elements 1316 and 1318 can be coupled to an outer surface 1321 of the fixed member 1320 and the inner surface 1325 of the moveable housing 1324. In other embodiments, the shock absorber elements 1312 and 1314 can be coupled to an intermediate member 1326 of the moveable member 1322 that can be disposed about and secured to the outer surface of the moveable member 1322 and an inner surface 1325 of the moveable housing 1324 and the shock absorber elements 1316 and 1318 can be coupled to an intermediate member 1327 of the fixed member 1320 that can be disposed about and secured to the outer surface 1321 of the fixed member 1320 and the inner surface 1325 of the moveable housing 1324.

The shock absorber elements 1312, 1314, 1316, and 1318 can be made from rubber or any other suitable elastomer. In some embodiments the shock absorber elements can be made from vulcanized rubber or other thermoplastic elastomer. In some embodiments, the shock absorber elements can have a minimum tensile strength of 18 MPa, as measured according to ASTM D412-16(2021). In some embodiments, the shock absorber elements can have a minimum elongation at break of 450%, as measured according to ASTM D412-16(2021). In some embodiments, the shock absorber elements can have a minimum tear resistance of 80 kN/m, as measured according to ASTM D624-00(2020), Method B. In some embodiments, the shock absorber elements can have a maximum compression set of 25%, as measured according to ASTM D395-18, Method B. In some embodiments, the shock absorber elements can exhibit no cracking under dynamic ozone testing conditions, as measured according to ASTM D1149-18.

The shock absorber elements 1312/1314 and 1316/1318 can be secured to the moveable member 1322 and the fixed member 1320, respectively, and the moveable housing 1324 via any suitable manner. In some embodiments, a bond having a sufficient strength can be formed between the shock absorber elements and the moveable housing 1324 and the moveable member 1322 or the fixed member 1320 during the manufacture of the shock absorber arrangement 1310. In some embodiments, an adhesive can be used to secure the shock absorber elements 1312, 1314, 1316, and 1318. In other embodiments one or more mechanical fasteners, e.g., screws, bolts, bolts and nuts, rivets, rods, or the like, can be used to secure the shock absorber elements 1312, 1314, 1316, and 1318.

As shown in FIG. 13, the shock absorber elements 1312, 1314, 1316, and 1318 are in an unloaded position. As a tension or load is applied to the connector structure 1111 (or the end of the moveable member 1322) the shock absorber elements 1312, 1314, 1316, and 1318 can deform to move the shock absorber elements 1312, 1314, 1316, and 1318 into a loaded position or state. FIG. 14 depicts a side elevation view of the stinger 1300 in a loaded position, according to one or more embodiments. As shown in FIGS. 13 and 14, as the shock absorber elements 1312, 1314, 1316, and 1318 move from the unloaded position to the loaded position the moveable housing 1324 and the moveable member 1322 move toward the first end 1107 of the stinger 1300. The moveable member 1322 can further extend from the first end 1107 of the stinger 1300 in the loaded position as compared to the unloaded position. As shown, an end of the intermediate member 1326 can contact the first end 1107 of the stinger 1105 such that the moveable member 1222 can be prevented from moving any further toward the first end 107 of the stinger 1105. In other embodiments, if the shock absorber element 1312 is coupled directly to the outer surface 1323 of the moveable member 1322, a stop can be formed on the outer surface 1323 between the first end 107 of the stinger 1300 and the shock absorber element 1312 that can prevent the moveable member 1322 from extending too far out of the stinger 1300.

FIGS. 15-20 depict an illustrative connection process connecting a vessel 101 to a disconnectable yoke mooring system 100, according to one or more embodiments described. The particular lifting device shown in FIGS. 15-20 includes the lifting device 500 described above with reference to FIG. 5. It should be understood that any lifting devices described herein can be used to connect the vessel 101 to the yoke mooring system 100. Continuing with reference to FIGS. 1, 5-8, and 15-20, in some embodiments, the vessel 101 can approach the yoke mooring system 100 and can retrieve float lines 1505 (as shown) or lifting lines 506 (two lifting lines or float lines 1505 can be present when the yoke mooring system 100 includes two link arms 117, 118) should the float line 1505 not be used. At this stage the ballast tank 116 can be resting on the seabed 105 or, as shown, on an optional landing pad 1510 and the second ends 123, 124 of the link arms 117, 118 or, as shown, the releasable connectors 125, 126 can also be resting on the seabed 105 (as shown) or another optional landing pad.

The float lines 1505 or the lifting lines 506 can be pulled in via the rotary winches 504 disposed on the vessel 101. In some embodiments, a clump weight 1512 can be disposed on an end of the lifting lines 506 that can be removed when pulled up to the vessel. When the float lines 1505 are used, the float lines 1505 can be disconnected from the lifting lines 506 and the ends of the lifting lines 506 can be connected to the rotary winches 504. In some embodiments, the float lines 1505 and/or the lifting lines 506 can include distance markers thereon that can be used to determine how much float line 1505 and/or lifting line 506 remains to be pulled in by the rotary winches 504.

As the rotary winches 504 pull the lifting lines 506 onto the vessel, the lifting lines can begin to lift the second ends 123, 124 of the link arms 117, 118 up off the seabed 105 and toward the vessel 101. When the second ends 123, 124 of the link arms are raised high enough off the seabed 105 the ballast tank 116 can begin to be lifted. In some embodiments, prior to lifting the ballast tank 116 off the seabed 105 the lifting line can include the chain 510 connected to the second ends 123, 124 of the link arms 117, 118 or, as shown, the releasable connectors 125, 126 disposed thereon. When the chain 510 reaches the vessel 101, the chain 510 can be connected to the chain jack 502, strand jack, linear winch, or the like and the chain jack 502, strand jack, liner winch, or the like can be used to pull the ballast tank 116 and yoke 109 away from the seabed 105. In other embodiments, prior to lifting the ballast tank 116 off the seabed the lifting line can include a mating surface configured to connect to a traveling block as discussed above with reference to FIGS. 6-8. When the mating surface 114 reaches the vessel, the mating surface 114 can be connected to the traveling block 608 and the second rotary winch 606 can be used to pull the ballast tank 116 and yoke 109 away from the seabed 105. The link arms 117, 118 can be lifted off the seabed 105 such that the first component and the second component of the releasable connectors 125, 126 can be engaged with and secured to one another to secure the vessel 101 to the yoke mooring system 100, 200, 900, 1000.

In some embodiments, prior to lifting the link arms 117, 118, ballast tank 116, and yoke 109 toward the vessel 101 and off the seabed 105, one or more buoyancy modules 1002 disposed on or otherwise connected to the ballast tank 116 and/or the yoke 109 (see FIG. 10) can be filled with a fluid, e.g., air, as to reduce the weight of the yoke 109 and the ballast tank 116. In some embodiments, once the vessel 101 has been connected to the yoke mooring system 100, 200, 900, 1000, water can be introduced into the one or more buoyancy modules 1002 to displace at least a portion of the fluid therefrom.

In some embodiments, the vessel 101 can be moored to the mooring buoy 902 floating on the surface 102 of the body of water 103 prior to or while lifting the lifting lines 506, where the mooring buoy 902 is connected to the turntable 107 and/or the yoke 109 and/or the ballast tank 116 with a mooring line 904. In some embodiments, the process can further include disconnecting the vessel 101 from the mooring buoy 902 upon connection of the first component of the first and second releasable connectors to the second component of the first and second releasable connectors.

In some embodiments, a process for disconnecting the vessel 101 secured to the mooring structure 100, 200, 900, 1000 can include, if present, conveying a fluid into the buoyancy module 1002 to reduce a weight of the yoke 109 with respect to the first and second lifting devices. The process can also include applying a tension to the first and second lifting lines with the first and second lifting devices to remove at least a portion of a tension load from the first and second releasable connectors 125, 126. The first component from the second component of the first and second releasable connectors 125, 126 can be released. The first and second components of the first and second releasable connectors 125, 126 can be lowered toward the seabed 105 such that the yoke 109 and the ballast tank 116 can rest on the seabed. The link arms 117, 118 can also be lowered such that the link arms 117, 118 also rest on the seabed 105. The vessel 101 can be maneuvered away from the yoke mooring system 100, 200, 900, 1000. In some embodiments, when the optional buoyancy module 1002 is used, the process can also include introducing water into the buoyancy module 1002 to displace at least a portion of the fluid therefrom once the first and second components of the first and second releasable connectors 125, 126 have been released from one another, e.g., once the yoke 109 rests on the seabed 105.

In some embodiments, as noted above, the yoke mooring system 100 can include the landing pad 1510 that can be disposed on the seabed 105 beneath at least a portion of the yoke 109 and/or ballast tank 116 such that when the yoke mooring system is disconnected, it can be set on the landing pad 1510. The landing pad can be incorporated into any of the embodiments described herein. The landing pad 1510 can be configured as a steel frame, or steel or concrete mattresses, or other similar material. The landing pad 1510 can provide a hard surface for the yoke 109 and/or ballast tank 116 to land on such that the yoke 109 and/or ballast tank 116 does not get stuck or adhere to the seabed 105 which is possible as some seabeds can often have a very soft, muddy consistency. In some embodiments, the landing pad 1510 can encircle the base structure 104 such that the yoke mooring system 100 can be disconnected from the vessel 101 about any point of rotation around the base structure 104 while still being able to rest the yoke 109 and/or ballast tank 116 on the landing pad 1510. In other embodiments, the landing pad 1510 can be positioned in a sector such that the yoke mooring system 100 can be disconnected from the vessel 101 with the vessel 101 in a specific orientation with respect to the base structure 104 while being able to rest the yoke 109 and/or ballast tank 116 on the landing pad 1510.

The present disclosure further relates to any one or more of the following numbered embodiments:

1. A disconnectable yoke mooring system for mooring a vessel floating on a surface of a body of water, comprising: a base structure configured to be disposed on a seabed; a turntable configured to be connected to the base structure such that the turntable is rotatable with respect to the base structure about a vertical axis; a yoke comprising a first end and a second end, wherein the first end of the yoke is configured to be connected to the turntable in a manner permitting the yoke to at least partially rotate about a longitudinal axis of the yoke and to at least partially rotate about a second axis that is substantially orthogonal to the longitudinal axis of the yoke; a first link arm and a second link arm each having a first end connected to the second end of the yoke; a first releasable connector and a second releasable connector each comprising a first component disposed on a second end of the first link arm and a second end of the second link arm, respectively, and a second component configured to be disposed on the vessel; a first lifting line and a second lifting line each having a first end configured to be connected to the second end of the first link arm and the second link arm, respectively; and a first lifting device and a second lifting device each configured to be disposed on the vessel, wherein the first lifting device and the second lifting device are configured to be connected to a second end of the first lifting line and a second end of the second lifting line, respectively, wherein, when the first and second lifting devices are disposed on the vessel and connected to the second end of the first and second lifting lines, respectively, and the first end of the first and second lifting lines are connected to the second end of the first and second link arms, respectively, the first and second lifting devices are configured to lift and lower the first and second link arms and the yoke.

2. The system of paragraph 1, wherein the first and second lifting devices are configured to lift and lower the first and second link arms and the yoke at a speed that is independent from a motion of the vessel.

3. The system of paragraph 1 or paragraph 2, wherein the second end of the yoke comprises a ballast tank or a weight, and wherein the first and second link arms are connected to the ballast tank or the weight.

4. The system of any one of paragraphs 1 to 3, wherein: the first lifting device comprises a first chain jack, a first strand jack, or a first linear winch, and the second lifting device comprises a second chain jack, a second strand jack, or a second linear winch.

5. The system of any one of paragraphs 1 to 3, wherein: the first lifting device comprises a first rotary winch and a first chain jack, the second lifting device comprises a second rotary winch and a second chain jack, the first lifting line comprises a first chain segment having a first end connected to the second end of the first link arm and a second end connected to a first end of a first retrieval line, the second lifting line comprises a second chain segment having a first end connected to the second end of the second link arm and a second end connected to a first end of a second retrieval line, the first rotary winch is configured to be connected to a second end of the first retrieval line, the second rotary winch is configured to be connected to a second end of the second retrieval line, the first rotary winch is configured to lift and lower the first link arm via the first retrieval line, the second rotary winch is configured to lift and lower the second link arm via the second first retrieval line, the first chain jack and the second chain jack are configured to lift and lower the first and second link arms and the yoke via the first chain segment and the second chain segment, respectively.

6. The system of any one of paragraphs 1 to 3, wherein: the first lifting device comprises a first rotary winch and a first strand jack or a first linear winch, the second lifting device comprises a second rotary winch and a second strand jack or a second linear winch, the first rotary winch is configured to lift and lower the first link arm via the first lifting line, the second rotary winch is configured to lift and lower the second link arm via second lifting line, the first strand jack or the first linear winch and the second strand jack or the second linear winch are configured to lift and lower the first and second link arms and the yoke via the first and second lifting lines, respectively.

7. The system of any one of paragraphs 1 to 3, wherein: the first lifting line comprises a first connector disposed between the first end and the second end thereof, the first connector comprising a mating surface, the second lifting line comprises a second connector disposed between the first end and the second end thereof, the second connector comprising a mating surface, the first lifting device comprises a first rotary winch having a first independent drum and a second independent drum, the second lifting device comprises a second rotary winch having a first independent drum and a second independent drum, the second independent drum of the first lifting device comprises a first end of a first hoisting line connected thereto, the second independent drum of the second lifting device comprises a first end of a second hoisting line connected thereto, the first hoisting line is reeved around a first sheave disposed above a first traveling block, a second sheave disposed on the first traveling block, and connected at a second end thereof at a point on the vessel located above the first traveling block, the second hoisting line is reeved around a first sheave disposed above a second traveling block, a second sheave disposed on the second traveling block, and connected at a second end thereof at a point on the vessel located above the second traveling block, the first and second traveling blocks each comprise a receptacle configured to receive the mating surface of the first and second lifting lines, respectively, and the first drum of the first rotary winch and the first drum of the second rotary winch are configured to lift the first and second lifting lines, respectively, to move the mating surfaces of the first and second connectors, respectively, to permit engagement of the mating surfaces with the receptacles of the first and second traveling blocks, respectively 8. The system of paragraph 7, wherein: the first hoisting line is reeved around the first sheave disposed above the first traveling block, the second sheave disposed on the first traveling block, a third sheave disposed above the first traveling block, a fourth sheave disposed on the first traveling block, and connected at the second end thereof at the point on the vessel located above the first traveling block, the second hoisting line is reeved around the first sheave disposed above the second traveling block, the second sheave disposed on the second traveling block, a third sheave disposed above the second traveling block, a fourth sheave disposed on the second traveling block, and connected at the second end thereof at the point on the vessel located above the second traveling block.

9. The system of any one of paragraphs 1 to 8, further comprising a buoyancy module disposed on the yoke toward the second end thereof, wherein the buoyancy module is configured to contain a fluid within an internal volume thereof.

10. The system of paragraph 9, wherein the buoyancy module comprises a flexible bladder.

11. The system of any one of paragraphs 1 to 10, further comprising: a swivel comprising a fixed part disposed on the base structure and a rotatable part disposed on the turntable; and a fluid transfer conduit in fluid communication with the rotatable part of the swivel and the vessel, wherein the fixed part of the swivel is in fluid communication with a subsea pipeline, and wherein the fluid transfer conduit is configured to transfer a fluid from the rotating part of the swivel to the vessel or from the vessel to the rotating part of the swivel.

12. The system of claim 11, wherein the fluid transfer conduit comprises a first flexible conduit in fluid communication with the vessel and a first end of a rigid conduit coupled to one of the first and second link arms and a second flexible conduit in fluid communication with the rotatable part of the swivel and a second end of the rigid conduit.

13. The system of paragraph 12, wherein the first flexible conduit is configured to be disconnected from the rigid conduit and remain with the vessel when the submerged yoke mooring system is disconnected from the vessel, and wherein the rigid conduit and the second flexible conduit are configured to remain with the submerged yoke mooring system when the submerged yoke mooring system is disconnected from the vessel.

14. The system of any one of paragraphs 1 to 13, further comprising a landing pad configured to be disposed on the seabed, and wherein the landing pad is configured to support at least a portion of the yoke when the submerged yoke mooring system is disconnected from the vessel.

15. The system of any one of paragraphs 1 to 13, further comprising: one or more fenders disposed on the yoke, or one or more fenders configured to be disposed on a landing pad that configured to be disposed on the seabed, wherein the one or more fenders are configured to absorb an impact force when the submerged yoke mooring system is disconnected from the vessel and lowered onto the seabed.

16. The system of any one of paragraphs 1 to 15, further comprising a mooring buoy floating on the surface of the water, wherein the mooring buoy is connected to the turntable, the yoke, or a combination thereof.

17. The system of any one of paragraphs 1 to 16, further comprising a jetting system, wherein, when the first and second lifting devices are disposed on the vessel and connected to the second end of the first and second lifting lines, respectively, and the first end of the first and second lifting lines are connected to the second end of the first and second link arms, respectively, the jetting system is configured to eject a gas, a liquid, or a combination thereof from the yoke toward the seabed prior to or when the first and second lifting devices disposed on the vessel lift the first and second link arms and the yoke.

18. The system of any one of paragraphs 1 to 17, wherein: the first component of the first releasable connector comprises a first stinger comprising a first end and a second end, the first component of the second releasable connector comprises a second stinger comprising a first end and a second end, an outer surface of the first and second stingers defines a first groove located toward the first end thereof and a second groove located toward the second end thereof, the first end of the first stinger is connected to the second end of the first link arm, the first end of the second stinger is connected to the second end of the second link arm, the first end of the first lifting line is connected to the second end of the first stinger, the first end of the second lifting line is connected to the second end of the second stinger, the second component of the first releasable connector comprises a first sleeve assembly comprising a first end, a second end, and a first latching mechanism, the second component of the second releasable connector comprises a second sleeve assembly comprising a first end, a second end, and a second latching mechanism, the first sleeve assembly is configured to receive the first stinger and secure the first stinger therein via the first latching mechanism, and the second sleeve assembly is configured to receive the second stinger and secure the second stinger therein via the second latching mechanism.

19. The system of paragraph 18, wherein the stinger further comprises a shock absorber arrangement at least partially disposed therein, and wherein the shock absorber arrangement is configured to reduce dynamic loading during connection of the stinger to the sleeve assembly.

20. The system of any one of paragraphs 1 to 19, wherein the yoke is configured to be disposed below the surface of the body of water when the vessel is moored to the yoke mooring system.

21. A process for connecting a vessel to a disconnectable yoke mooring system, comprising: positioning the vessel near the yoke mooring system, wherein the yoke mooring system comprises: a base structure disposed on a seabed; a turntable connected to the base structure such that the turntable is rotatable with respect to the base structure about a vertical axis; a yoke having a first end connected to the turntable in a manner permitting the yoke to at least partially rotate about a longitudinal axis of the yoke and to at least partially rotate about a second axis that is orthogonal to the longitudinal axis of the yoke; a first link arm and a second link arm each having a first end connected to a second end of the yoke; a first releasable connector and a second releasable connector each comprising a first component disposed on a second end of the first link arm and a second end of the second link arm, respectively, and a second component disposed on the vessel, wherein the yoke and the first and second link arms are resting on a seabed; a first lifting line comprising a first chain segment having a first end connected to the second end of the first link arm and a second end connected to a first end of a first retrieval line; a second lifting line comprising a first chain segment having a first end connected to the second end of the second link arm and a second end connected to a first end of a second retrieval line; a first lifting device comprising a first rotary winch and a first chain jack disposed on the vessel; and a second lifting device comprising a second rotary winch and a second chain jack disposed on the vessel; connecting a second end of the first retrieval line to the first rotary winch; connecting a second end of the second retrieval line to the second rotary winch; hauling in the first retrieval line and the second retrieval line with the first and second rotary winches until the second end of the first and second chain segments reach the first and second chain jacks, respectively; connecting the first and the second chain segments to the first and the second chain jacks, respectively; lifting the first and second link arms and the yoke with the first and second chain jacks; and connecting the first component of the first and second releasable connectors with the second component of the first and second releasable connectors, respectively, to secure the vessel to the yoke mooring system.

22. A process for connecting a vessel to a disconnectable yoke mooring system, comprising: positioning the vessel near the yoke mooring system, wherein the yoke mooring system comprises: a base structure disposed on a seabed; a turntable connected to the base structure such that the turntable is rotatable with respect to the base structure about a vertical axis; a yoke having a first end connected to the turntable in a manner permitting the yoke to at least partially rotate about a longitudinal axis of the yoke and to at least partially rotate about a second axis that is orthogonal to the longitudinal axis of the yoke; a first link arm and a second link arm each having a first end connected to a second end of the yoke; a first releasable connector and a second releasable connector each comprising a first component disposed on a second end of the first link arm and a second end of the second link arm, respectively, and a second component disposed on the vessel, wherein the yoke and the first and second link arms are resting on a seabed; a first lifting line having a first end connected to the second end of the first link arm; a second lifting line having a first end connected to the second end of the second link arm; a first lifting device comprising a first rotary winch and a first strand jack or a first linear winch disposed on the vessel; and a second lifting device comprising a second rotary winch and a second strand jack or a second linear winch disposed on the vessel; connecting a second end of the first lifting line to the first rotary winch; connecting a second end of the second lifting line to the second rotary winch; hauling in the first lifting line and the second lifting line with the first and second rotary winches until the first and second link arms are raised off the seabed while the yoke remains on the seabed; connecting the first lifting line to the first strand jack or the first linear winch; connecting the second lifting line to the second strand jack or the second linear winch; lifting the first and second link arms and the yoke with the first strand jack or the first linear winch and the second strand jack or the second linear winch; and connecting the first component of the first and second releasable connectors with the second component of the first and second releasable connectors, respectively, to secure the vessel to the yoke mooring system.

23. A process for connecting a vessel to a disconnectable yoke mooring system, comprising: positioning the vessel near the yoke mooring system, wherein the yoke mooring system comprises: a base structure disposed on a seabed; a turntable connected to the base structure such that the turntable is rotatable with respect to the base structure about a vertical axis; a yoke having a first end connected to the turntable in a manner permitting the yoke to at least partially rotate about a longitudinal axis of the yoke and to at least partially rotate about a second axis that is orthogonal to the longitudinal axis of the yoke; a first link arm and a second link arm each having a first end connected to a second end of the yoke; a first releasable connector and a second releasable connector each comprising a first component disposed on a second end of the first link arm and a second end of the second link arm, respectively, and a second component disposed on the vessel, wherein the yoke and the first and second link arms are resting on a seabed; a first lifting line comprising a first connector disposed between a first end and a second end thereof, the first connector comprising a mating surface, and the first end of the first lifting line is connected to the second end of the first link arm; a second lifting line comprising a second connector disposed between a first end and a second end thereof, the second connector comprising a mating surface, and the first end of the second lifting line is connected to the second end of the second link arm; a first lifting device comprising a first rotary winch having a first independent drum and a second independent drum disposed on the vessel; a second lifting device comprising a second rotary winch having a first independent drum and a second independent drum disposed on the vessel; a first hoisting line having a first end connected to the second independent drum of the first rotary winch, wherein the first hoisting line is reeved around a first sheave disposed above a first traveling block, a second sheave disposed on the first traveling block, and connected at a second end thereof at a point on the vessel located above the first traveling block; a second hoisting line having a first end connected to the second independent drum of the second rotary winch, wherein the second hoisting line is reeved around a first sheave disposed above a second traveling block, a second sheave disposed on the second traveling block, and connected at a second end thereof at a point on the vessel located above the second traveling block, wherein the first and second traveling blocks each comprise a receptacle configured to receive the mating surface of the first and second connectors, respectively; connecting the second end of the first lifting line to the first independent drum of the first rotary winch; connecting the second end of the second lifting line to the first independent drum of the second rotary winch; hauling in the first and the second lifting line with the first independent drums of the first and second rotary winches until the mating surfaces of the first and second lifting are in an engageable position with receptacles of the first and second traveling blocks, respectively; securing the first and second connectors to the receptacles of the first and second traveling blocks, respectively; lifting the first and second link arms and the yoke with the second independent drums of the first and second lifting devices respectively; and connecting the first component of the first and second releasable connectors with the second component of the first and second releasable connectors, respectively, to secure the vessel to the yoke mooring system.

24. A process for connecting a vessel to a disconnectable yoke mooring system, comprising: positioning the vessel near the yoke mooring system, wherein the yoke mooring system comprises: a base structure disposed on a seabed; a turntable connected to the base structure such that the turntable is rotatable with respect to the base structure about a vertical axis; a yoke having a first end connected to the turntable in a manner permitting the yoke to at least partially rotate about a longitudinal axis of the yoke and to at least partially rotate about a second axis that is orthogonal to the longitudinal axis of the yoke; a buoyancy module disposed on the yoke toward the second end thereof, wherein the buoyancy module is configured to contain a fluid within an internal volume thereof; a first link arm and a second link arm each having a first end connected to a second end of the yoke; a first releasable connector and a second releasable connector each comprising a first component disposed on a second end of the first link arm and a second end of the second link arm, respectively, and a second component disposed on the vessel, wherein the yoke and the first and second link arms are resting on a seabed; a first lifting line having a first end connected to the second end of the first link arm; a second lifting line having a first end connected to the second end of the second link arm; and a first lifting device and a second lifting device disposed on the vessel; connecting a second end of the first lifting line to the first lifting device; connecting a second end of the second lifting line to the second lifting device; conveying a fluid into the buoyancy module to reduce a weight of the yoke with respect to the first and second lifting devices; hauling in the first lifting line and the second lifting line with the first and second lifting devices, respectively, until the first component of the first and second releasable connectors are in an engagement position with respect to the second component of the first and second releasable connectors, wherein the fluid is conveyed into the buoyancy module before and/or while the first and second lifting lines are hauled in; and connecting the first component of the first and second releasable connectors to the second component of the first and second releasable connectors, respectively, to secure the vessel to the yoke mooring system.

25. The process of paragraph 24, further comprising mooring the vessel to a mooring buoy floating on the surface of the body of water prior to lifting the first and second retrieval lines, wherein the mooring buoy is connected to the turntable and/or the yoke with a mooring line.

26. The process of paragraph 25, further comprising disconnecting the vessel from the mooring buoy upon connection of the first component of the first and second releasable connectors to the second component of the first and second releasable connectors.

27. The process of any one of paragraphs 24 to 26, further comprising introducing water into the buoyancy module to displace at least a portion of the fluid therefrom upon connection of the first component of the first and second releasable connectors to the second component of the first and second releasable connectors.

28. The process of any one of paragraph 27, further comprising: conveying a fluid into the buoyancy module to reduce a weight of the yoke with respect to the first and second lifting devices; applying a tension to the first and second lifting lines with the first and second lifting devices to remove at least a portion of a tension load from the first and second releasable connectors; releasing the first component from the second component of the first and second releasable connectors; lowering the first component of the first and second releasable connectors toward the seabed such that the yoke rests on the seabed; and maneuvering the vessel away from the yoke mooring system.

29. The process of paragraph 28, further comprising introducing water into the buoyancy module to displace at least a portion of the fluid therefrom once the yoke rests on the seabed.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A disconnectable submerged yoke mooring system for mooring a vessel floating on a surface of a body of water, comprising:

a base structure configured to be disposed on a seabed;

a turntable configured to be connected to the base structure such that the turntable is rotatable with respect to the base structure about a vertical axis;

a yoke comprising a first end and a second end, wherein the first end of the yoke is configured to be connected to the turntable in a manner permitting the yoke to at least partially rotate about a longitudinal axis of the yoke and to at least partially rotate about a second axis that is substantially orthogonal to the longitudinal axis of the yoke;

a first link arm and a second link arm each having a first end connected to the second end of the yoke;

a first releasable connector and a second releasable connector each comprising a first component disposed on a second end of the first link arm and a second end of the second link arm, respectively, and a second component configured to be disposed on the vessel;

a first lifting line and a second lifting line each having a first end configured to be connected to the second end of the first link arm and the second link arm, respectively; and a first lifting device and a second lifting device each configured to be disposed on the vessel, wherein:

the first lifting device comprises a first chain jack, a first strand jack, a first linear winch, a first rotary winch, a first windlass, or a combination thereof, and the second lifting device comprises a second chain jack, a second strand jack, a second linear winch, a second rotary winch, a second windlass, or a combination thereof, the first lifting device and the second lifting device are configured to be connected to a second end of the first lifting line and a second end of the second lifting line, respectively, and when the first and second lifting devices are disposed on the vessel and connected to the second end of the first and second lifting lines, respectively, and the first end of the first and second lifting lines are connected to the second end of the first and second link arms, respectively, the first and second lifting devices are configured to lift and lower the first and second link arms and the yoke.

2. The system of claim 1, wherein the first and second lifting devices are configured to lift and lower the first and second link arms and the yoke at a speed that is independent from a motion of the vessel.

3. The system of claim 1, wherein the second end of the yoke comprises a ballast tank or a weight, and wherein the first and second link arms are connected to the ballast tank or the weight.

4. The system of claim 1, wherein:

the first lifting device comprises the first chain jack, the first strand jack, or the first linear winch, and the second lifting device comprises the second chain jack, the second strand jack, or the second linear winch.

5. The system of claim 1, wherein:

the first lifting device comprises the first rotary winch and the first chain jack, the second lifting device comprises the second rotary winch and the second chain jack, the first lifting line comprises a first chain segment having a first end connected to the second end of the first link arm and a second end connected to a first end of a first retrieval line, the second lifting line comprises a second chain segment having a first end connected to the second end of the second link arm and a second end connected to a first end of a second retrieval line, the first rotary winch is configured to be connected to a second end of the first retrieval line, the second rotary winch is configured to be connected to a second end of the second retrieval line, the first rotary winch is configured to lift and lower the first link arm via the first retrieval line, the second rotary winch is configured to lift and lower the second link arm via the second retrieval line, and the first chain jack and the second chain jack are configured to lift and lower the first and second link arms and the yoke via the first chain segment and the second chain segment, respectively.

6. The system of claim 1, wherein:

the first lifting device comprises the first rotary winch and the first strand jack or the first linear winch, the second lifting device comprises the second rotary winch and the second strand jack or the second linear winch, the first rotary winch is configured to lift and lower the first link arm via the first lifting line, the second rotary winch is configured to lift and lower the second link arm via second lifting line, and the first strand jack or the first linear winch and the second strand jack or the second linear winch are configured to lift and lower the first and second link arms and the yoke via the first and second lifting lines, respectively.

7. The system of claim 1, wherein:

the first lifting line comprises a first connector disposed between the first end and the second end thereof, the first connector comprising a mating surface, the second lifting line comprises a second connector disposed between the first end and the second end thereof, the second connector comprising a mating surface, the first lifting device comprises the first rotary winch, wherein the first rotary winch comprises a first independent drum and a second independent drum, the second lifting device comprises the second rotary winch, wherein the second rotary winch comprises a first independent drum and a second independent drum, the second independent drum of the first lifting device comprises a first end of a first hoisting line connected thereto, the second independent drum of the second lifting device comprises a first end of a second hoisting line connected thereto, the first hoisting line is reeved around a first sheave disposed above a first traveling block, a second sheave disposed on the first traveling block, and connected at a second end thereof at a point on the vessel located above the first traveling block, the second hoisting line is reeved around a first sheave disposed above a second traveling block, a second sheave disposed on the second traveling block, and connected at a second end thereof at a point on the vessel located above the second traveling block, the first and second traveling blocks each comprise a receptacle configured to receive the mating surface of the first and second lifting lines, respectively, and the first drum of the first rotary winch and the first drum of the second rotary winch are configured to lift the first and second lifting lines, respectively, to move the mating surfaces of the first and second connectors, respectively, to permit engagement of the mating surfaces with the receptacles of the first and second traveling blocks, respectively.

8. The system of claim 7, wherein:

the first hoisting line is reeved around the first sheave disposed above the first traveling block, the second sheave disposed on the first traveling block, a third sheave disposed above the first traveling block, a fourth sheave disposed on the first traveling block, and connected at the second end thereof at the point on the vessel located above the first traveling block, and the second hoisting line is reeved around the first sheave disposed above the second traveling block, the second sheave disposed on the second traveling block, a third sheave disposed above the second traveling block, a fourth sheave disposed on the second traveling block, and connected at the second end thereof at the point on the vessel located above the second traveling block.

9. The system of claim 1, further comprising a buoyancy module disposed on the yoke toward the second end thereof, wherein the buoyancy module is configured to contain a fluid within an internal volume thereof.

10. The system of claim 9, wherein the buoyancy module comprises a flexible bladder.

11. The system of claim 1, further comprising:

a swivel comprising a fixed part disposed on the base structure and a rotatable part disposed on the turntable; and a fluid transfer conduit in fluid communication with the rotatable part of the swivel and the vessel, wherein the fixed part of the swivel is in fluid communication with a subsea pipeline, and wherein the fluid transfer conduit is configured to transfer a fluid from the rotating part of the swivel to the vessel or from the vessel to the rotating part of the swivel.

12. The system of claim 11, wherein the fluid transfer conduit comprises a first flexible conduit in fluid communication with the vessel and a first end of a rigid conduit coupled to one of the first and second link arms and a second flexible conduit in fluid communication with the rotatable part of the swivel and a second end of the rigid conduit.

13. The system of claim 12, wherein the first flexible conduit is configured to be disconnected from the rigid conduit and remain with the vessel when the submerged yoke mooring system is disconnected from the vessel, and wherein the rigid conduit and the second flexible conduit are configured to remain with the submerged yoke mooring system when the submerged yoke mooring system is disconnected from the vessel.

14. The system of claim 1, further comprising a landing pad configured to be disposed on the seabed, and wherein the landing pad is configured to support at least a portion of the yoke when the submerged yoke mooring system is disconnected from the vessel.

15. The system of claim 1, further comprising:

one or more fenders disposed on the yoke, or one or more fenders configured to be disposed on a landing pad that is configured to be disposed on the seabed, wherein the one or more fenders are configured to absorb an impact force when the submerged yoke mooring system is disconnected from the vessel and lowered onto the seabed.

16. The system of claim 1, further comprising a mooring buoy floating on the surface of the water, wherein the mooring buoy is connected to the turntable, the yoke, or a combination thereof.

17. The system of claim 1, further comprising a jetting system, wherein, when the first and second lifting devices are disposed on the vessel and connected to the second end of the first and second lifting lines, respectively, and the first end of the first and second lifting lines are connected to the second end of the first and second link arms, respectively, the jetting system is configured to eject a gas, a liquid, or a combination thereof from the yoke toward the seabed prior to or when the first and second lifting devices disposed on the vessel lift the first and second link arms and the yoke.

18. The system of claim 1, wherein:

the first component of the first releasable connector comprises a first stinger comprising a first end and a second end, the first component of the second releasable connector comprises a second stinger comprising a first end and a second end, an outer surface of the first and second stingers defines a first groove located toward the first end thereof and a second groove located toward the second end thereof, the first end of the first stinger is connected to the second end of the first link arm, the first end of the second stinger is connected to the second end of the second link arm, the first end of the first lifting line is connected to the second end of the first stinger, the first end of the second lifting line is connected to the second end of the second stinger, the second component of the first releasable connector comprises a first sleeve assembly comprising a first end, a second end, and a first latching mechanism, the second component of the second releasable connector comprises a second sleeve assembly comprising a first end, a second end, and a second latching mechanism, the first sleeve assembly is configured to receive the first stinger and secure the first stinger therein via the first latching mechanism, and the second sleeve assembly is configured to receive the second stinger and secure the second stinger therein via the second latching mechanism.

19. The system of claim 18, wherein the stinger further comprises a shock absorber arrangement at least partially disposed therein, and wherein the shock absorber arrangement is configured to reduce dynamic loading during connection of the stinger to the sleeve assembly.

20. The system of claim 1, wherein the yoke is configured to be disposed below the surface of the body of water when the vessel is moored to the submerged yoke mooring system.

21. The system of claim 1, wherein the first and second lifting devices are configured to operate at a speed that is correlated to account for a motion of the vessel.

22. The system of claim 1, wherein:

the first link arm comprises one or more chains, one or more cables, or a combination thereof, and the second link arm comprises one or more chains, one or more cables, or a combination thereof.

23. The system of claim 1, wherein:

the second component of the first releasable connector comprises a first mooring cradle configured to receive and secure the first component of the first releasable connector to the vessel when the first mooring cradle is disposed on the vessel, and the second component of the second releasable connector comprises a second mooring cradle configured to receive and secure the first component of the second releasable connector to the vessel when the second mooring cradle is disposed on the vessel.

24. The system of claim 1, wherein:

the first link arm comprises an axial bearing disposed at one end thereof, and the second link arm comprises an axial bearing disposed at one end thereof.

25. The system of claim 1, wherein the first link arm comprises one or more chains and an axial bearing disposed at one end thereof, and the second link arm comprises one or more chains and an axial bearing disposed at one end thereof.

26. The system of claim 1, wherein:

the first lifting device comprises the first rotary winch, the second lifting device comprises the second rotary winch, and the first and second rotary winches are configured to lift and lower the first and second link arms and the yoke via the first and second lifting lines, respectively.

27. The system of claim 26, wherein the first link arm comprises one or more chains, and the second link arm comprises one or more chains.

28. The system of claim 1, wherein:

the first lifting device comprises the first windlass, the second lifting device comprises the second windlass, and the first and second windlasses are configured to lift and lower the first and second link arms and the yoke via the first and second lifting lines, respectively.

29. The system of claim 28, wherein the first link arm comprises one or more chains, and the second link arm comprises one or more chains.

30. The system of claim 1, wherein:

the second end of the yoke comprises a ballast tank or a weight, the first and second link arms are connected to the ballast tank or the weight, the first link arm comprises one or more chains, the second link arm comprises one or more chains, the first lifting device comprises the first rotary winch or the first windlass, the second lifting device comprises the second rotary winch or the second windlass, the first and second rotary winches or the first and second windlasses are configured to lift and lower the first and second link arms and the yoke via the first and second lifting lines, respectively, and the first and second lifting devices are configured to lift and lower the first and second link arms and the yoke at a speed that is independent from a motion of the vessel.

* * * * *